US009560715B2

(12) United States Patent
Kurita et al.

(10) Patent No.: US 9,560,715 B2
(45) Date of Patent: Jan. 31, 2017

(54) LIGHT SOURCE APPARATUS AND DISPLAY APPARATUS HAVING A PLURALITY OF REFLECTION UNIT EACH WITH A SUBSTANTIALLY N-SIDED PYRAMID SHAPE AND A DETECTION UNIT

(71) Applicant: CANON KABUSHIKI KAISHA, Tokyo (JP)

(72) Inventors: Masanao Kurita, Isehara (JP); Masahiro Kamiyoshihara, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 147 days.

(21) Appl. No.: 14/630,731

(22) Filed: Feb. 25, 2015

(65) Prior Publication Data

US 2015/0243206 A1 Aug. 27, 2015

(30) Foreign Application Priority Data

Feb. 27, 2014 (JP) ..... 2014-036394

(51) Int. Cl.
*H05B 33/08* (2006.01)
*G09G 3/34* (2006.01)

(52) U.S. Cl.
CPC ..... *H05B 33/0869* (2013.01); *G09G 3/342* (2013.01); *G09G 2320/0626* (2013.01); *G09G 2360/145* (2013.01)

(58) Field of Classification Search
CPC ..... G02B 19/0085; G02B 6/0021; H05B 33/0869; H05B 37/0227; G02F 1/1335; G09G 2360/145
USPC ..... 250/205, 239, 216, 208.1; 257/80–85; 313/110, 498–512; 362/297, 607–623
See application file for complete search history.

(56) References Cited

U.S. PATENT DOCUMENTS 9,274,370 B2 * 3/2016 Kamiyoshihara ..... G02F 1/1336

FOREIGN PATENT DOCUMENTS

| | | |
|---|---|---|
| JP | 2001-142409 A | 5/2001 |
| JP | 2006-339148 A | 12/2006 |
| JP | 2013-211176 A | 10/2013 |

* cited by examiner

*Primary Examiner* — Que T Le
(74) *Attorney, Agent, or Firm* — Cowan, Liebowitz & Latman, P.C.

(57) ABSTRACT

A light source apparatus comprises: a substrate; a light emission unit that is provided on the substrate; a plurality of reflection units configured to reflect light from the light emission unit; and a first detection unit that is provided on the substrate and detects the light from the light emission unit, wherein each of the reflection units has a substantially n-sided pyramid shape and is provided such that a bottom surface thereof is in parallel with the substrate, and the first detection unit is provided between a vertex of an n-sided polygon corresponding to the bottom surface of one of two of the reflection units adjacent to each other and a vertex of an n-sided polygon corresponding to the bottom surface of the other of two of the reflection units adjacent to each other.

18 Claims, 19 Drawing Sheets

| | ADJUSTMENT OPTICAL SENSOR | ERROR CORRECTION OPTICAL SENSOR |
|---|---|---|
| REFERENCE DETECTED VALUE | 1.00 | 1.00 |
| POST-CHANGE DETECTED VALUE | 0.90 | 0.90 |
| POST-WARP DETECTED VALUE | 0.85 | 1.40 |

LIGHT SOURCE APPARATUS AND DISPLAY APPARATUS HAVING A PLURALITY OF REFLECTION UNIT EACH WITH A SUBSTANTIALLY N-SIDED PYRAMID SHAPE AND A DETECTION UNIT

BACKGROUND OF THE INVENTION

Field of the Invention

The present invention relates to a light source apparatus and a display apparatus.

Description of the Related Art

Some color image display apparatuses have color liquid crystal panels having color filters and light source apparatuses (backlight apparatuses) that emit white light to the back surfaces of the color liquid crystal panels.

Conventionally, a fluorescent lamp such as a cold cathode fluorescent lamp (CCFL) or the like has been mainly used as the light source of the light source apparatus. However, in recent years, a light-emitting diode (LED) excellent in terms of power consumption, life, color reproducibility, and environmental load is used increasingly as the light source of the light source apparatus.

The light source apparatus (LED backlight apparatus) that uses the LED as the light source usually has a large number of the LEDs. Japanese Patent Application Laid-open No. 2001-142409 discloses the LED backlight apparatus that has a plurality of light emission units each having one or more LEDs. In addition, Japanese Patent Application Laid-open No. 2001-142409 discloses that the brightness of the light emission unit is controlled for each light emission unit. By reducing the light emission brightness of the light emission unit that emits light to an area of a screen of a color image display apparatus in which a dark image is displayed, power consumption is reduced and the contrast of the image is improved. Such brightness control for each light emission unit corresponding to the feature of the image is called local dimming control.

When the spread of light from the light emission unit is suppressed, it is possible to increase the degree of improvement of the contrast by the local dimming control. Specifically, in the case where the leakage of light emitted from one light emission unit to the area corresponding to the other light emission unit is suppressed, it is possible to increase the degree of improvement of the contrast by the local dimming control. For example, as disclosed in Japanese Patent Application Laid-open No. 2006-339148, by surrounding the light source with a plurality of reflection units (conical reflection units), it is possible to suppress the spread of light from the light emission unit and increase the degree of improvement of the contrast by the local dimming control.

The light source apparatus has a problem that the light emission brightness of the light emission unit changes. The change of the light emission brightness occurs due to, e.g., the change of light emission characteristics of the light source caused by the change of temperature, the aged deterioration of the light source, and the like. In a light emission apparatus having a plurality of the light emission units, a variation in temperature or aged deterioration between the plurality of the light emission units causes a variation in light emission brightness (brightness variation) between the plurality of the light emission units.

As a method for reducing the change of the light emission brightness and the brightness variation, there is known a method in which the light emission brightness of the light emission unit is adjusted by using an optical sensor that detects light emitted from the light emission unit. Specifically, there is known the method in which the optical sensor that detects reflected light emitted from the light emission unit and reflected toward the light emission unit by an optical sheet (optical member) of the light source apparatus is provided, and the light emission brightness of the light emission unit is adjusted based on the detected value of the optical sensor. In the light emission apparatus having the plurality of the light emission units, the light emission units are turned on one by one successively and a process in which the reflected light is detected and the light emission brightness is adjusted is performed for each light emission unit. Such a technique is disclosed in, e.g., Japanese Patent Application Laid-open No. 2013-211176.

SUMMARY OF THE INVENTION

However, when the reflection unit disclosed in Japanese Patent Application Laid-open No. 2006-339148 is used, a large amount of the reflected light from the reflection unit enters the optical sensor, and hence it has not been possible to detect the reflected light emitted from the light emission unit and reflected by the optical sheet with high accuracy.

The present invention provides a technique capable of detecting light from a light emission unit with high accuracy by devising the arrangement of a detection unit that detects the light from the light emission unit and a reflection unit in a substantially polygonal pyramid shape.

The present invention in its first aspect provides a light source apparatus comprising:

a substrate;

a light emission unit that is provided on the substrate;

a plurality of reflection units configured to reflect light from the light emission unit; and a first detection unit that is provided on the substrate and detects the light from the light emission unit, wherein each of the reflection units has a substantially n-sided pyramid shape (n is an integer not less than 3) and is provided such that a bottom surface thereof is in parallel with the substrate, and the first detection unit is provided between a vertex of an n-sided polygon corresponding to the bottom surface of one of two of the reflection units adjacent to each other and a vertex of an n-sided polygon corresponding to the bottom surface of the other of two of the reflection units adjacent to each other.

The present invention in its second aspect provides a display apparatus comprising:

the light source apparatus; and a display unit that displays an image on a screen by modulating light from the light source apparatus.

According to the present invention, it is possible to detect the light from the light emission unit with high accuracy by devising the arrangement of the detection unit that detects the light from the light emission unit and the reflection unit in the substantially polygonal pyramid shape.

Further features of the present invention will become apparent from the following de script ion of exemplary embodiments with reference to the attached drawings.

DESCRIPTION OF THE EMBODIMENTS

First Embodiment

Hereinbelow, a description will be given of a display apparatus, a light source apparatus, and a control method thereof according to a first embodiment of the present invention.

Note that, in the present embodiment, a description will be given of an example in which the light source apparatus is a backlight apparatus used in a color image display apparatus, but the light source apparatus is not limited to the backlight apparatus used in the display apparatus. The light source apparatus may also be a lighting apparatus such as a streetlight, an indoor lighting apparatus, or an illuminating apparatus for microscopes.

In addition, in the present embodiment, a description will be given of an example in which the display apparatus is a transmissive liquid crystal display apparatus, but the display apparatus is not limited thereto. The display apparatus according to the present embodiment may be any display apparatus that displays an image on a screen by modulating light from the light source apparatus. For example, the display apparatus according to the present embodiment may be a reflective liquid crystal display apparatus. The display apparatus according to the present embodiment may also be an MEMS shutter display that uses a micro electro mechanical system (MEMS) shutter instead of a liquid crystal device. The display apparatus may also be a monochrome image display apparatus.

Figure 1:
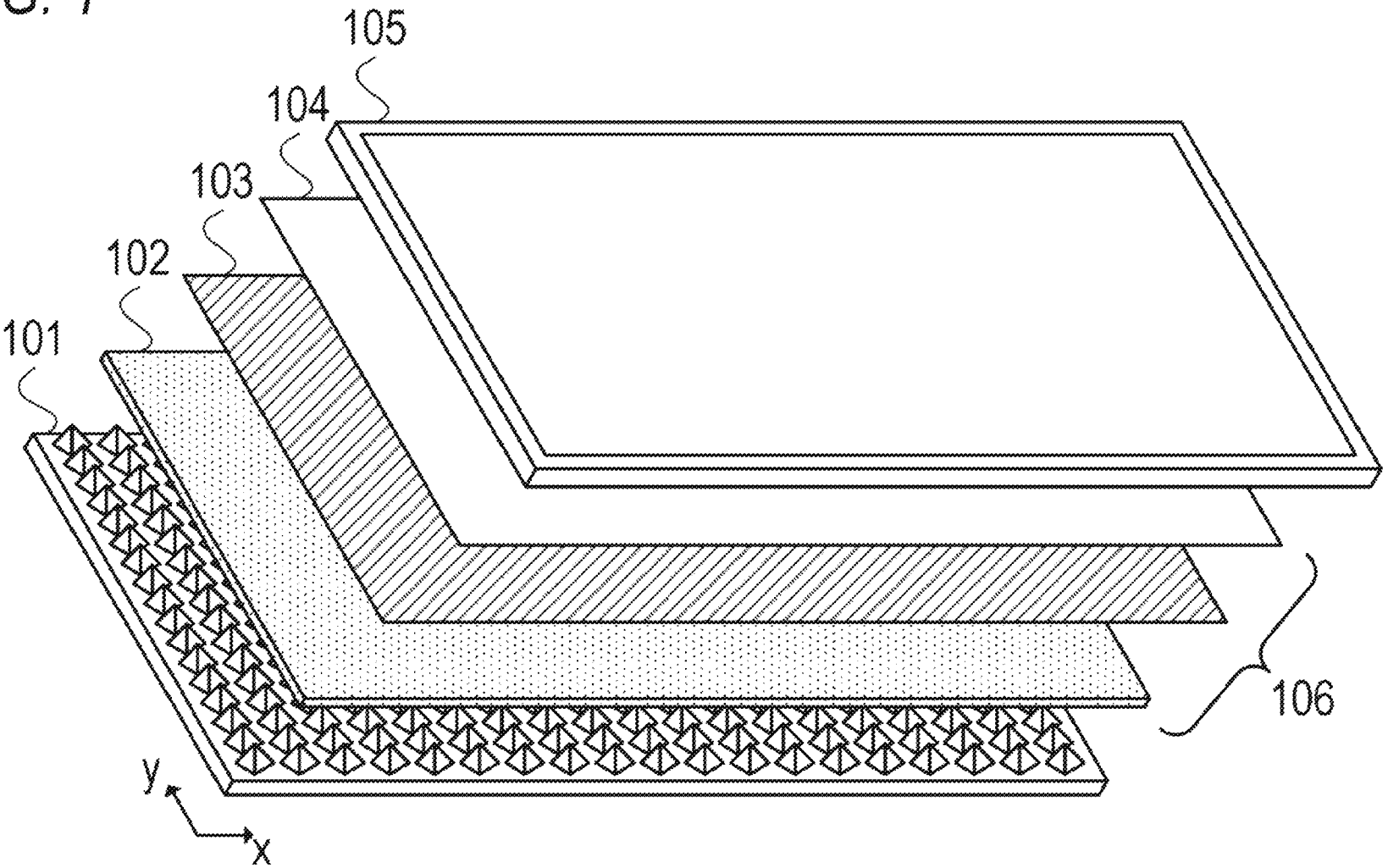
FIG. 1 shows an example of the configuration of a color image display apparatus according to a first embodiment.

FIG. 1 is a schematic view showing an example of the configuration of the color image display apparatus according to the present embodiment. The color image display apparatus has a backlight apparatus and a color liquid crystal panel 105. The backlight apparatus has a light source substrate 101, a diffuser 102, a condensing sheet 103, and a reflective polarizing film 104.

The light source substrate 101 emits light (white light) applied to the back surface of the color liquid crystal panel 105. One or more light sources are provided on the light source substrate 101. As the light source, it is possible to use a light-emitting diode (LED), a cold-cathode fluorescent lamp, and an organic EL device. In the present embodiment, a description will be given of an example in which an LED chip is used as the light source.

The diffuser 102, the condensing sheet 103, and the reflective polarizing film 104 are disposed at positions that face the light source (a light emission unit 111 described later). The diffuser 102, the condensing sheet 103, and the reflective polarizing film 104 are disposed in parallel with the light source substrate, and optically change light from the light source substrate 101 (specifically the light sources).

Specifically, the diffuser 102 causes the light source substrate 101 to function as a planar light source by diffusing the light from the light sources.

The condensing sheet 103 improves a front brightness (a brightness in a front direction) by condensing white light diffused by the diffuser 102 and incident at various angles of incidence in the front direction (on the side of the color liquid crystal panel 105).

The reflective polarizing film 104 improve the front brightness by polarizing the incident white light efficiently.

The diffuser 102, the condensing sheet 103, and the reflective polarizing film 104 are stacked on each other, and used. Hereinafter, these optical members are collectively referred to as an optical sheet 106. Note that the optical sheet 106 may include a member other than the above optical members or may not include at least one of the above optical members. In addition, the optical sheet 106 and the color liquid crystal panel 105 may be configured integrally.

There are cases where deformation (warp) occurs in the optical sheet 106 due to various factors such as thermal expansion, static electricity, secular change, and gravity. Since the warp occurs due to various factors, it is difficult to predict the warp of the optical sheet 106 precisely and prevent the formation of the warp.

The color liquid crystal panel 105 is a display unit that displays an image on a screen by transmitting light from the backlight apparatus. Specifically, the color liquid crystal panel 105 has a plurality of pixels including an R sub-pixel that transmits red light, a G sub-pixel that transmits green light, and a B sub-pixel that transmits blue light, and displays a color image by controlling the brightness of white light applied thereto for each sub-pixel.

The backlight apparatus having the configuration described above (the configuration shown in FIG. 1) is generally called a direct backlight apparatus.

In the present embodiment, the light source substrate 101 has a plurality of LED substrates 110 that are arranged in a matrix. Note that, in the present embodiment, a description will be given of an example in which the light source substrate 101 has a plurality of the LED substrates 110, but the number of LED substrates 110 may be one.

Figure 2A:
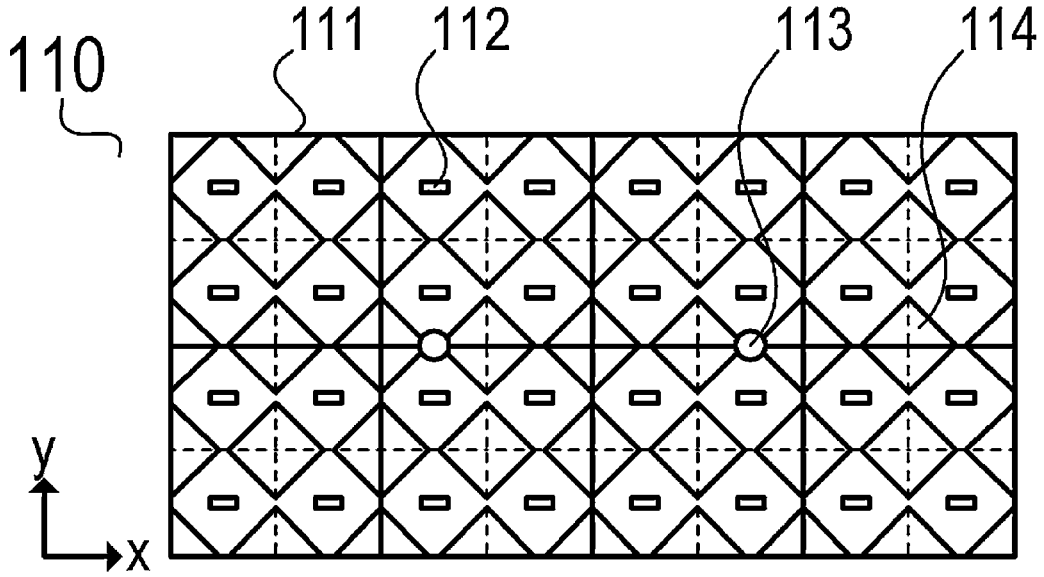
FIGS. 2A to 2D show examples of the configuration of an LED substrate according to the first embodiment.

FIG. 2A is a schematic view showing an example of the configuration of the LED substrate 110 as viewed from the front direction (the side of the color liquid crystal panel 105).

In the example in FIG. 2A, eight light emission units 111 arranged in two rows and four columns are provided on the LED substrate 110. Each of the light emission units 111 has four LED chips 112 arranged in two rows and two columns. Intervals of the four LED chips 112 in a row direction and in a column direction are equal to each other. In the present embodiment, it is possible to adjust (control) the light emission brightness of the plurality of the light emission units 111 individually. As the LED chip 112, it is possible to use a white LED. In addition, as the LED chip 112, it is also possible to use a chip configured such that white light is obtained by using a plurality of LEDs having different colors of emitted light (e.g., a red LED that emits red light, a green LED that emits green light, and a blue LED that emits blue light).

Note that the number of the light emission units 111 of the LED substrate 110 may be more than or less than eight. The number of the light emission units 111 of the LED substrate 110 may be one.

In addition, the number of the LED chips 112 of the light emission unit 111 may be more than or less than four. The number of the LED chips 112 of the light emission unit 111 may be one.

As shown in FIG. 2A, a reflection unit 114 that reflects light from the light emission unit 111 is provided on the LED substrate 110. The reflection unit 114 has a quadrangular pyramid shape, and is provided on the LED substrate 110 such that its bottom surface is in parallel with and faces the LED substrate 110. As the material of the reflection unit 114, it is possible to use, e.g., a white resin having high reflectance.

By providing the reflection unit 114, it is possible to level light from the light emission unit 111, and suppress the leakage of the light from the light emission unit 111 to areas corresponding to the other light emission units 111 (leakage of light). By extension, it is possible to increase the degree of improvement of contrast by local dimming control (brightness control for each light emission unit corresponding to the feature of an image).

When a plurality of (two or more) the reflection units 114 are provided so as to surround the light emission unit 111, it is possible to level light with high accuracy and suppress the leakage of light more efficiently. In the example in FIG. 2A, a plurality of the reflection units 114 are provided such that each light source (each LED chip 112) is surrounded by four of the reflection units 114 arranged in two rows and two columns, and the reflection unit 114 is disposed in the vicinity of the center of four of the LED chips 112 arranged in two rows and two columns. In addition, in the example in FIG. 2A, the reflection unit 114 is provided such that the bottom surface of the quadrangular pyramid is in parallel with the LED substrate 110 and four sides (bases) constituting the bottom surface of the reflection unit 114 face the four LED chips 112 described above at positions closest to the reflection unit 114.

In the example in FIG. 2A, four of the reflection units 114 are provided for one LED chip 112 and nine of the reflection units 114 are provided for one light emission unit 111, but the number of the reflection units 114 is not particularly limited. The number of the reflection units 114 for one LED chip 112 may be more than or less than four. One reflection unit 114 may be provided for one LED chip 112. The reflection unit 114 may also be provided not for each LED chip but for each light emission unit 111. The number of the reflection units 114 for one LED chip 112 may be more than or less than nine. For example, from among the nine reflection units 114, the reflection unit 114 provided in the center of the light emission unit 111 may be omitted. One reflection unit 114 may be provided for one light emission unit 111.

Figure 2B:
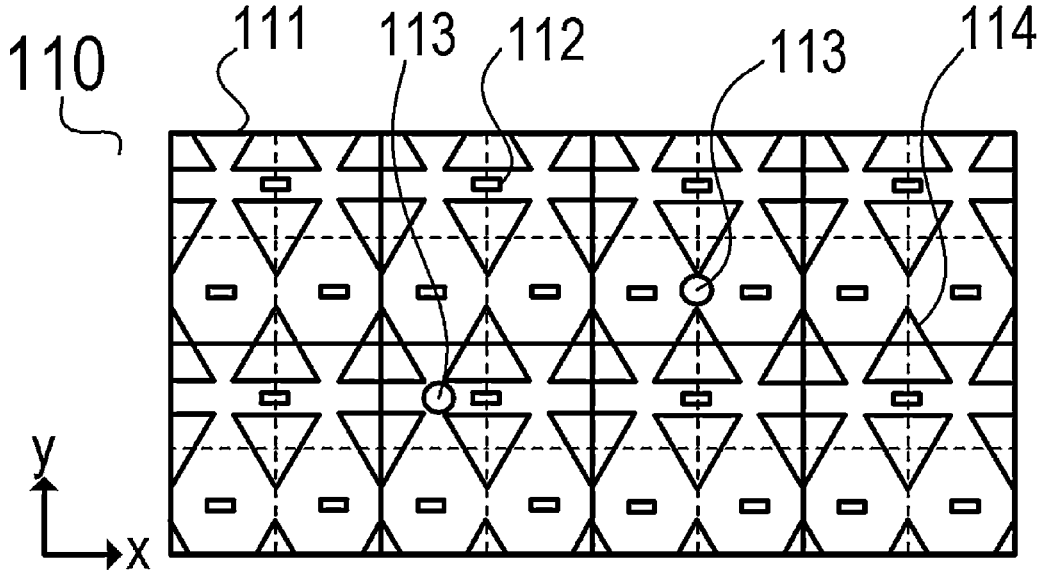

Note that the shape of the reflection unit 114 is not limited to the quadrangular pyramid shape. The shape of the reflection unit 114 may be a triangular pyramid shape or a hexagonal pyramid shape. FIG. 2B shows an example in which the reflection unit 114 in the triangular pyramid shape is used, and FIG. 2C shows an example in which the reflection unit 114 in the hexagonal pyramid shape is used.

Figure 2C:
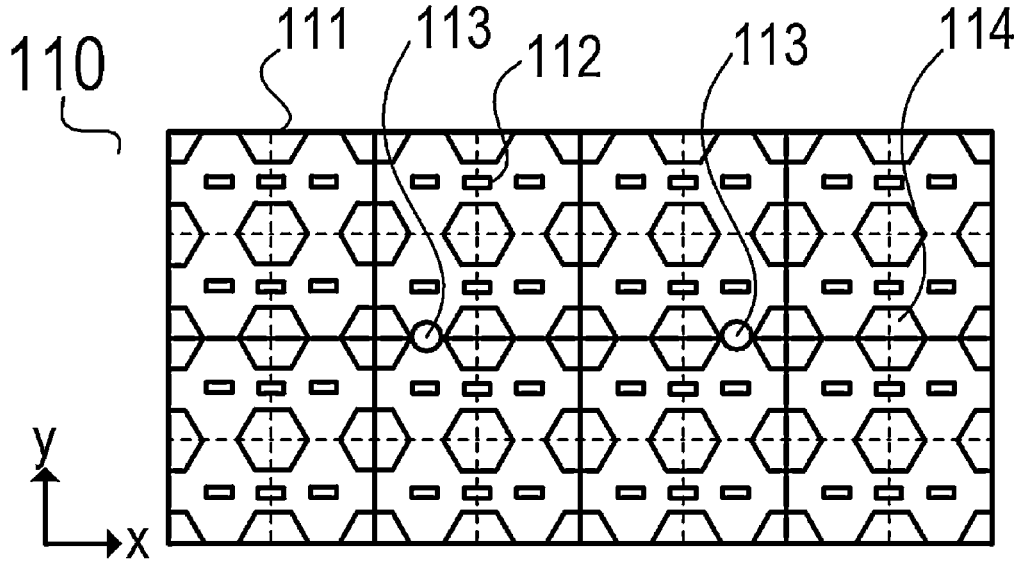
Figure 2D:
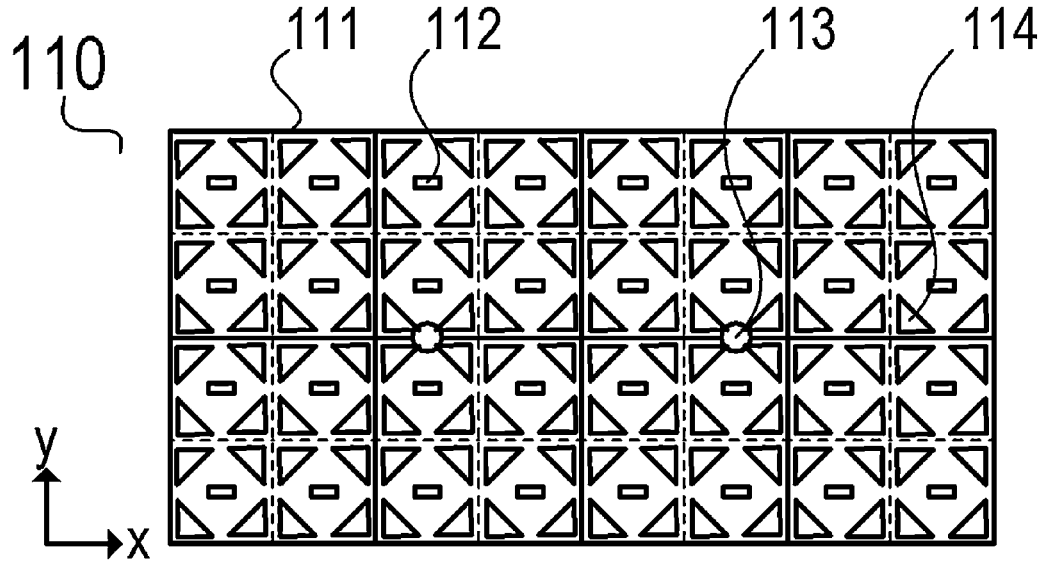

Note that, in the examples in FIGS. 2A to 2C, the reflection unit 114 of the LED chip 112 functions as the reflection unit 114 of the other LED chips 112, but the present invention is not limited thereto. The reflection unit 114 may be provided such that the reflection unit 114 of the LED chip 112 does not function as the reflection unit 114 of the other LED chips 112. FIG. 2D shows an example in which the reflection unit 114 of the LED chip 112 does not function as the reflection unit 114 of the other LED chips 112.

Note that the shape of the reflection unit 114 may also be a substantially polygonal pyramid shape (a substantially n-sided pyramid shape (n is an integer not less than 3)) similar to a polygonal pyramid shape instead of a regular polygonal pyramid shape. In this case, the LED chips 112 may appropriately be provided at positions that face sides of an n-sided polygon corresponding to the bottom surface of the reflection unit 114. With this, it is possible to efficiently reflect light from the LED chip 112 using the reflection unit 114. In the present embodiment, an n-sided polygon having points of interunit between extension lines of n hypotenuses of the reflection unit 114 in the substantially n-sided pyramid shape and the LED substrate 110 as vertices is defined as "an n-sided polygon corresponding to the bottom surface of the reflection unit 114". "The hypotenuse" is a side including the vertex of the reflection unit 114 (the vertex on the side of the optical sheet 106).

Note that a part of light from the light emission unit 111 is reflected by the optical sheet 106 and is returned to the side of the light emission unit. The reflection unit 114 also reflects light reflected by the optical sheet 106.

On the LED substrate 110, there is provided an optical sensor 113 (a first detection unit) that detects the light from the light emission unit 111 and outputs the detected value. A part of the light from the light emission unit 111 is reflected by the optical sheet 106 and is returned to the side of the light emission unit. The reflected light reflected by the optical sheet 106 and returned to the side of the light emission unit enters the optical sensor 113. Not only the reflected light from the optical sheet 106 but also direct light from the light emission unit 111 may also enter the optical sensor 113. That is, combined light in which the reflected light from the optical sheet 106 and the direct light from the light emission unit 111 are combined may enter the optical sensor 113. It is possible to predict the light emission brightness of the light emission unit 111 from the brightness of the light having entered the optical sensor 113. As the optical sensor 113, a sensor that outputs the detected value indicative of the brightness of light such as a photodiode or a phototransistor is used. Alternatively, a color sensor that outputs the detected value indicative of the color of light instead of the brightness of light may also be used as the optical sensor 113.

The light emission brightness of the light emission unit 111 changes due to the temperature and the aged deterioration of the light emission unit 111. To cope with this, in the present embodiment, the light emission brightness of the light emission unit 111 is adjusted based on the detected value of the optical sensor 113.

However, in the conventional art, a large amount of reflected light from the reflection unit 114 enters the optical sensor 113. Subsequently, with the warp of the optical sheet 106, the amount of the reflected light reflected by the reflection unit 114 and entering the optical sensor 113 significantly changes, and the detected value of the optical sensor 113 significantly changes. The light emission brightness of the light emission unit 111 is preferably adjusted based on the change of the detected value caused by the temperature change and the aged deterioration of the light emission unit 111. Accordingly, the change of the detected value caused by the warp of the optical sheet 106 becomes an error.

To cope with this, in the present embodiment, the optical sensor 113 is provided at a position at which the reflected light from the reflection unit 114 is not detected directly. Specifically, the optical sensor 113 is provided in the vicinity of the vertex of the n-sided polygon corresponding to the bottom surface of the reflection unit 114 so as not to face the side of the n-sided polygon corresponding to the bottom surface of the reflection unit 114. In the present embodiment, since the shape of the reflection unit 114 is the quadrangular pyramid shape, "the side of the n-sided polygon corresponding to the bottom surface of the reflection unit 114" can be considered as "the base of the reflection unit 114". In addition, "the vertex of the n-sided polygon corresponding to the bottom surface of the reflection unit 114" can be considered as "the vertex of the bottom surface of the reflection unit 114". Much of light incident on the reflection unit 114 is reflected from the side surface of the reflection unit 114 toward the position facing the base. Accordingly, the amount of light reflected from the reflection unit 114 toward the position that does not face the base of the reflection unit 114 is extremely smaller than the amount of light reflected from the reflection unit 114 toward the position that faces the base of the reflection unit 114. In the present embodiment, the optical sensor 113 is provided between the vertex of the n-sided polygon corresponding to the bottom surface of one of two of the reflection units 114 adjacent to each other and the vertex of the n-sided polygon corresponding to the bottom surface of the other of two of the reflection units 114 adjacent to each other so as not to face the base of the reflection unit 114. Specifically, the reflection unit in the quadrangular pyramid shape is used as the reflection unit 114, and the optical sensor 113 is provided between the vertices of the bottom surfaces of the two reflection units 114 adjacent to each other. With this, it is possible to detect the light from the light emission unit 111 with high accuracy. Specifically, it is possible to suppress the detection of the reflected light from the reflection unit 114 in the optical sensor 113 and reduce the error caused by the warp of the optical sheet 106. More specifically, it is possible to suppress the change of the detected value of the optical sensor 113 caused by the change of the reflected light from the reflection unit 114 resulting from the warp of the optical sheet 106.

In the present embodiment, the positions and the number of the optical sensors 113 are determined such that at least one optical sensor 113 is provided at a position having a distance from the light emission unit 111 corresponding to three to six times a diffusion distance for each of the light emission units 111. The diffusion distance is a distance between the light emission unit 111 and the optical sheet 106. Although details will be described later, by providing the optical sensor 113 at the position having the distance from the light emission unit 111 corresponding to three to six times the diffusion distance, it is possible to reduce the error caused by the warp of the optical sheet 106. Specifically, it is possible to suppress the change of the detected value of the optical sensor 113 caused by the change of the reflected light from the optical sheet 106 resulting from the warp of the optical sheet 106. In the example in FIG. 2A, two optical sensors 113 are provided for eight light emission units 111. With this, it is possible to provide one optical sensor 113 at the position having the distance from the light emission unit 111 corresponding to three to six times the diffusion distance for each of the eight light emission units 111.

Figure 3:
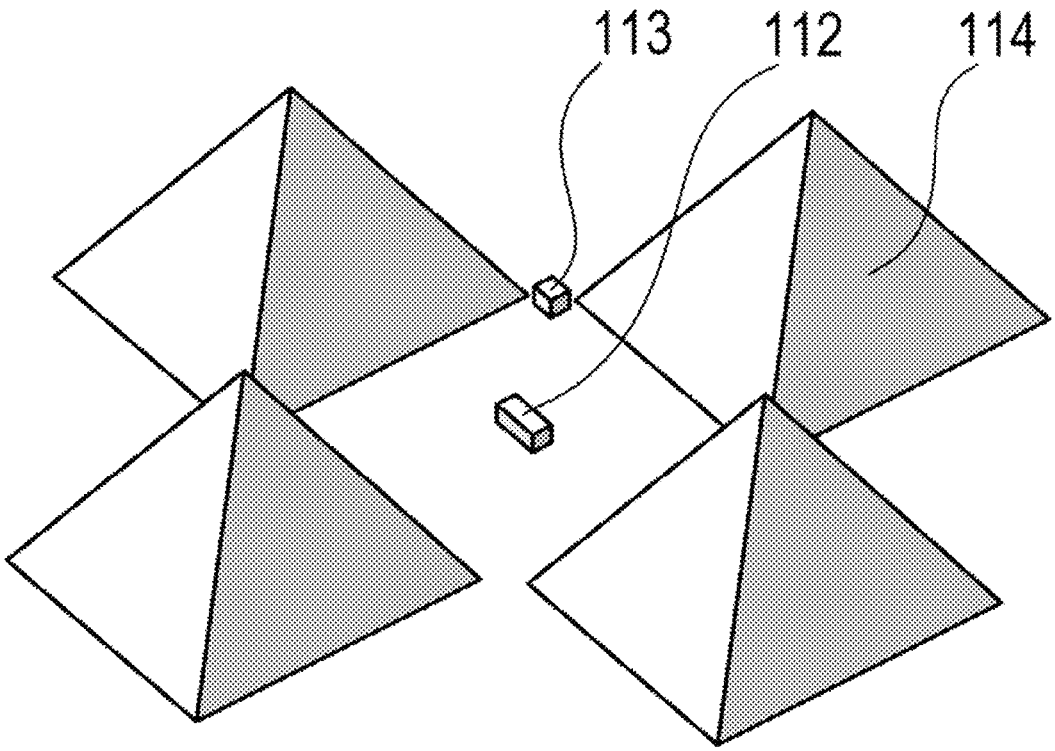
FIG. 3 shows an example of a positional relationship among an LED chip, an optical sensor, and a reflection unit according to the first embodiment.

FIG. 3 is a perspective view showing an example of a positional relationship among the LED chip 112, the optical sensor 113, and the reflection unit 114. From FIG. 3, it can be seen that the reflection unit 114 is provided such that the base faces the LED chip 112. In addition, it can be seen that the optical sensor 113 is provided between the vertices of the two reflection units 114 on the bottom surface side so as not to face the base of the reflection unit 114. In other words, the optical sensor 113 is provided at a position on the extension line of the side of the reflection unit 114 other than the base (the hypotenuse) and in the vicinity of the midpoint between the two reflection units 114 on the surface parallel with the light source substrate 101.

Figure 4:
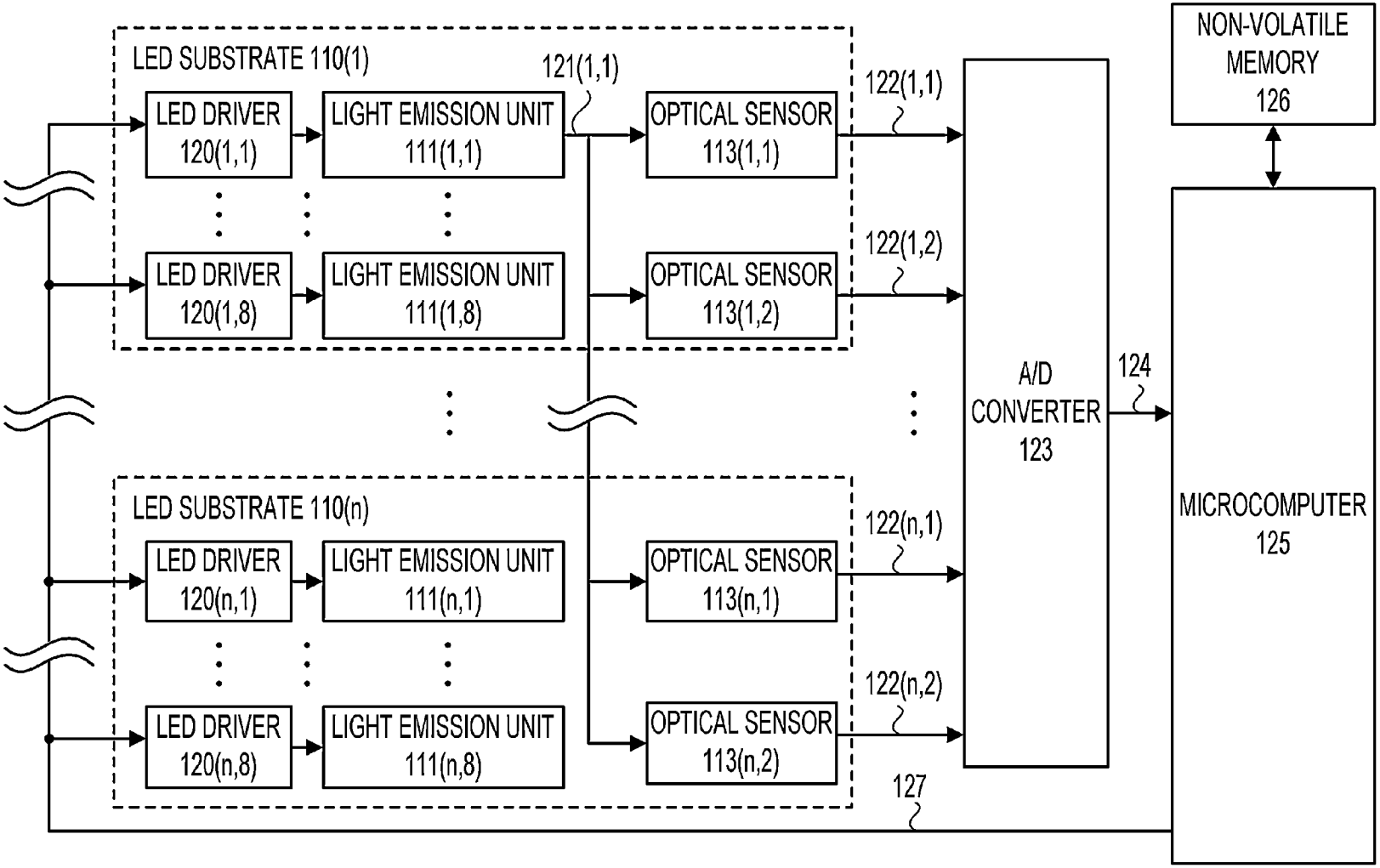
FIG. 4 shows an example of the configuration of a backlight apparatus according to the first embodiment.

FIG. 4 is a block diagram showing an example of the configuration of the backlight apparatus. In the present embodiment, the light source substrate 101 has n (n is an integer not less than 2) LED substrates 110(1) to 110(*n*). The configurations of the n LED substrates 110(1) to 110(*n*) are equal to each other, and hence the LED substrate 110(1) will be described as an example. The LED substrate 110(1) has light emission units 111(1, 1) to 111 (1, 8). The light emission units 111 (1, 1) to 111 (1, 8) are driven by LED drivers 120 (1, 1) to 120 (1, 8).

In the present embodiment, a light emission brightness adjustment process for reducing a brightness variation caused by a variation in temperature and aged deterioration between the light emission units 111 is performed periodically or at a predetermined timing. All of the light emission units 111 are turned on during a normal operation, but a plurality of the light emission units 111 are turned on one by one in a predetermined order in the light emission brightness adjustment process, and the reflected light is detected using the optical sensor 113. Subsequently, the light emission brightness of the light emission unit 111 is adjusted based on the detected value of the optical sensor 113.

FIG. 4 shows a turned-on state when the detected value used to adjust the light emission brightness of the light emission unit 111 (1, 1) is obtained. In FIG. 4, the light emission unit 111 (1, 1) is turned on, and the other light emission units 111 are turned off. Most of the light 121(1, 1) emitted from the light emission unit 111(1, 1) enters the color liquid crystal panel 105 (not shown in FIG. 4). However, apart of the light 121 (1, 1) is returned from the optical sheet 106 (not shown in FIG. 4) to the side of the light emission unit as the reflected light, and enters the individual optical sensors 113. Each of the optical sensors 113 outputs an analog value 122 (the detected value) indicative of the brightness in accordance with the brightness of the detected reflected light. An A/D converter 123 selects an analog value 122(1, 1) outputted by an optical sensor 113(1, 1) pre-associated with the light emission unit 111 (1, 1) from among the analog values 122 outputted by the individual optical sensors 113. Subsequently, the A/D converter 123 converts the selected analog value to a digital value through analog-digital conversion, and outputs a digital value 124 to a microcomputer 125. The optical sensor 113 pre-associated with the light emission unit 111 is used for adjusting the light emission brightness of the corresponding light emission unit 111. Therefore, hereinafter, the optical sensor is described as an adjustment optical sensor.

The other light emission units 111 are subjected to the same process. That is, the reflected light is detected by each optical sensor 113 in the state in which only the light emission unit 111 as the process target is turned on. Subsequently, in the A/D converter 123, the analog value 122 of the adjustment optical sensor 113 pre-associated with the light emission unit 111 as the adjustment target of the light emission brightness is converted to the digital value 124, and the digital value 124 is outputted to the microcomputer 125.

The microcomputer 125 adjusts the light emission brightness of the light emission unit 111 based on the detected value (specifically the digital value 124) of the optical sensor 113. In the present embodiment, the microcomputer 125 adjusts the light emission brightness of the light emission unit based on the detected value of the adjustment optical sensor for each of the light emission units. Specifically, a brightness target value (a target value of the detected value) of each light emission unit 111 determined at the time of a manufacturing test of the color image display apparatus is retained in a non-volatile memory 126. The microcomputer 125 compares the detected value of the optical sensor 113 associated with the light emission unit 111 with the target value for each of the light emission units 111. Subsequently, the microcomputer 125 adjusts the light emission brightness according to the result of the above comparison such that the detected value matches the target value for each of the light emission units 111. The light emission brightness is adjusted by adjusting, e.g., an LED driver control signal 127 outputted from the microcomputer 125 to the LED driver 120. The LED driver 120 drives the light emission unit 111 according to the LED driver control signal. The LED driver control signal represents, e.g., the pulse width of a pulse signal (a pulse signal of current or voltage) applied to the light emission unit 111. In this case, the light emission brightness of the light emission unit 111 is subjected to PWM control by adjusting the LED driver control signal. Note that the LED driver control signal is not limited thereto. For example, the LED driver control signal may represent the peak value of the pulse signal applied to the light emission unit 111 or may also represent both of the pulse width and the peak value. It is possible to reduce the brightness variation as the entire backlight apparatus by adjusting the light emission brightness of each light emission unit 111 such that the detected value matches the target value.

Figure 5:
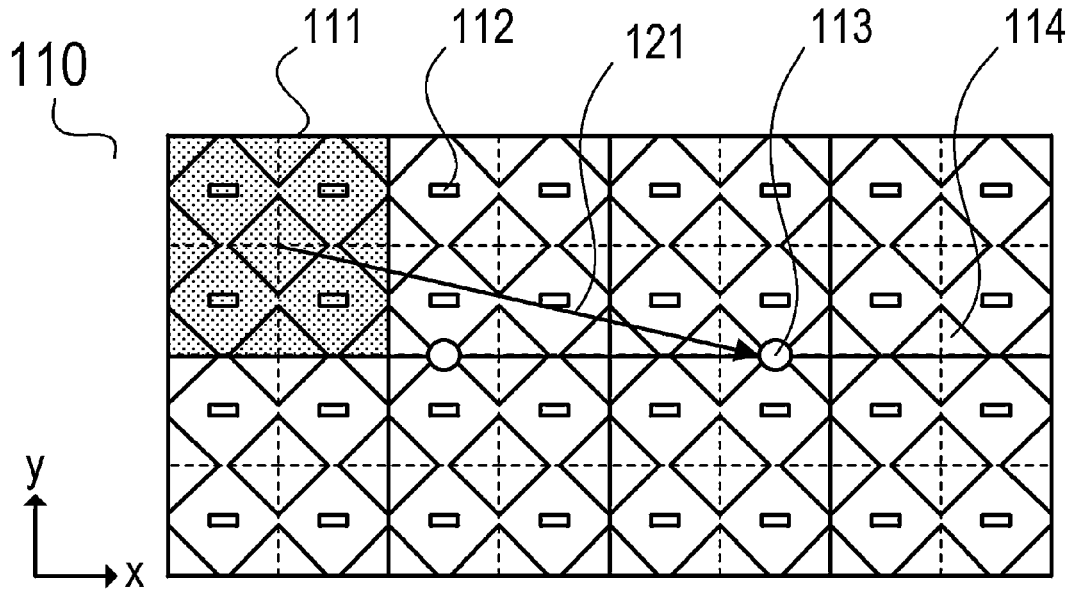
FIG. 5 shows an example of a positional relationship between a light emission unit and an adjustment optical sensor according to the first embodiment.

FIG. 5 is a schematic view showing an example of a positional relationship between the light emission unit 111 and the adjustment optical sensor. FIG. 5 shows an example in which the light emission unit 111 on the upper left corner is the adjustment target of the light emission brightness (a target light emission unit). In FIG. 5, only the target light emission unit is turned on and the other light emission units 111 are turned off. Light 121 from the target light emission unit is detected by the adjustment optical sensor pre-associated with the target light emission unit. In the present embodiment, the optical sensor 113 provided at the position having the distance from the target light emission unit corresponding to three to six times the diffusion distance is used as the adjustment optical sensor of the target light emission unit. Accordingly, the adjustment optical sensor of the target light emission unit is not necessarily the optical sensor 113 closest to the target light emission unit.

Figure 6:
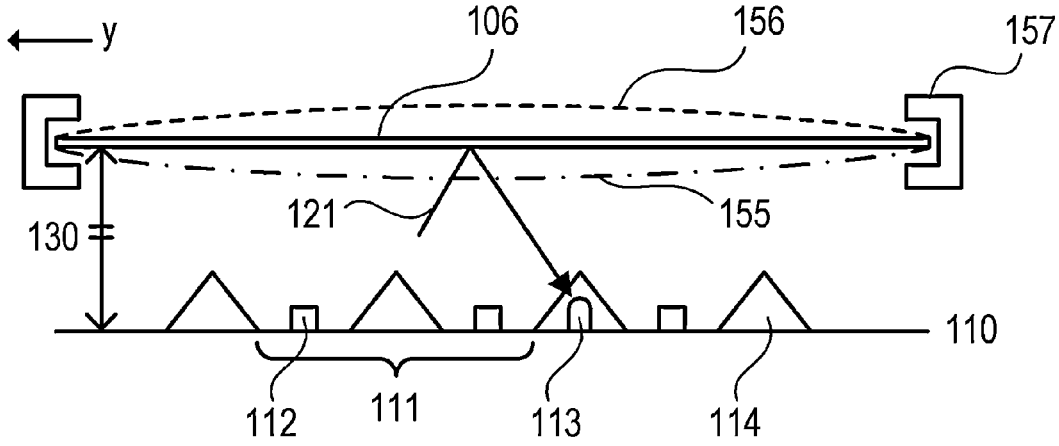
FIG. 6 shows an example of a positional relationship among the light emission unit, the optical sensor, the reflection unit, and an optical sheet according to the first embodiment.

FIG. 6 is a cross-sectional view showing an example of a positional relationship among the LED substrate 110, the light emission unit 111, the optical sensor 113, the reflection unit 114, and the optical sheet 106. FIG. 6 is a cross-sectional view when the LED substrate 110 in FIG. 5 is viewed from an x direction.

A diffusion distance 130 as the distance between the LED substrate 110 and the optical sheet 106 is preferably about 0.7 to 1.5 times the distance between the LED chips 112 (an LED pitch) in general.

The peripheral portion of the optical sheet 106 is fixed using an optical sheet fixing member 157. However, in the optical sheet 106, the warp having a warp amount that is larger with approach to the central portion thereof and smaller with approach to the peripheral portion thereof occurs due to factors such as thermal expansion, static electricity, aged deterioration, and gravity. With regard to the direction of the warp, a warp 155 in a minus direction in which the entire optical sheet 106 approaches the LED substrate 110 and a warp 156 in a plus direction in which the entire optical sheet 106 moves away from the LED substrate 110 occur. A local warp or swell can occur in addition to these warps, but the warp 155 in the minus direction or the warp 156 in the plus direction is predominant in general.

Next, a description will be given of a relationship between the change amount of the detected value caused by the warp of the optical sheet 106 and a ratio Rd (a ratio of a distance between the center of light emission of the light emission unit 111 and the optical sensor 113 to the diffusion distance 130).

Figure 7:
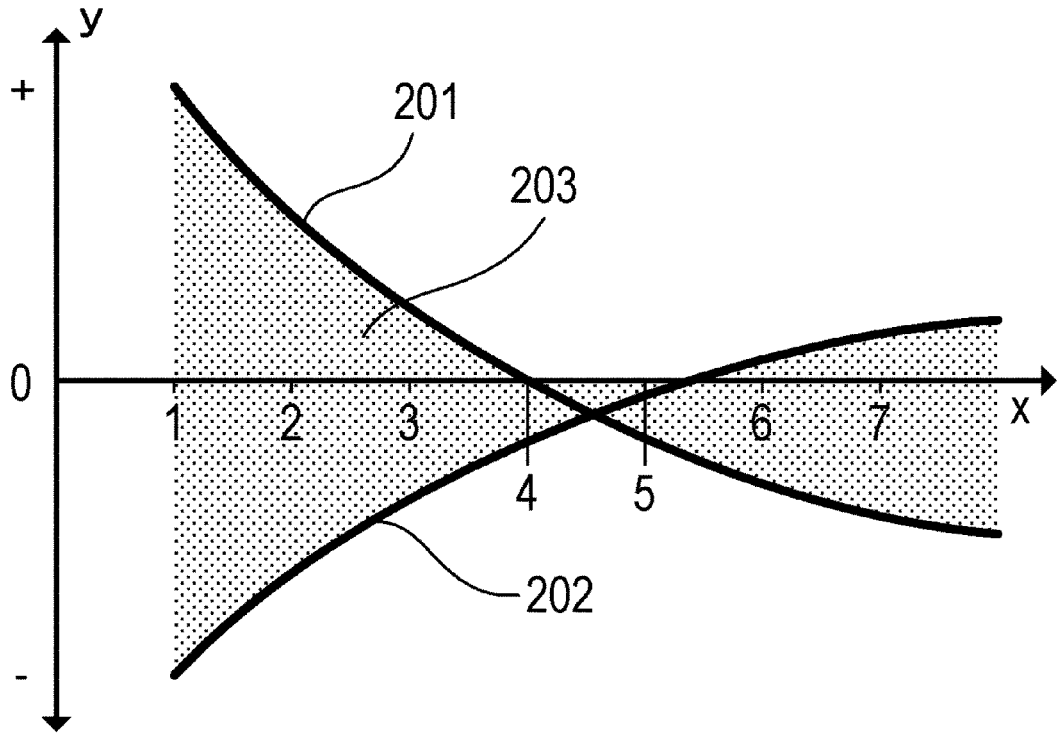
FIG. 7 shows an example of a relationship between a change amount of a detected value and a ratio Rd according to the first embodiment.

FIG. 7 is a view showing an example of the relationship between the change amount of the detected value (detected brightness) caused by the warp of the optical sheet 106 and the ratio Rd. In FIG. 7, the x-axis indicates the ratio Rd, and the y-axis indicates the change of the detected value caused by the warp of the optical sheet 106. A curve 201 indicates the change amount of the detected brightness in the case where the optical sheet 106 is warped in the minus direction by a predetermined amount. A curve 202 indicates the change amount of the detected brightness in the case where the optical sheet 106 is warped in the plus direction by a predetermined amount.

From FIG. 7, it can be seen that the change amount of the detected brightness caused by the warp of the optical sheet is lager with approach to the position (the position of the light emission unit 111) of the ratio Rd=0. In addition, it can be seen that the change amount of the detected brightness is small in a range of the ratio Rd=4 to 6. Further, in a range of the ratio Rd>6, it can be seen that the change amount of the detected brightness is larger as the ratio Rd is larger.

In the microcomputer 125, the brightness target value determined at the time of the manufacturing test of the color image display apparatus is compared with the detected brightness of the optical sensor 113, and the light emission brightness of the light emission unit 111 is adjusted. Consequently, all of the change amount of the detected brightness caused by the warp from the state of the optical sheet 106 when the brightness target value is determined becomes the error. Herein, a filled portion 203 in FIG. 7 corresponds to the error in the detected brightness.

From the foregoing, it can be seen that it is possible to suppress the error in the detected value caused by the warp of the optical sheet 106 to a value not more than a predetermined value by using the optical sensor 113 provided at the position (the position of the ratio Rd=3 to 6) having the distance from the light emission unit 111 corresponding to three to six times the diffusion distance 130.

As described thus far, according to the present embodiment, by devising the arrangement of the detection unit that detects the light from the light emission unit and the reflection unit in the substantially polygonal pyramid shape, it is possible to detect the light from the light emission unit with high accuracy. In addition, it is possible to obtain the detected value having the small error caused by the warp of the optical sheet 106 as the detected value of the optical sensor 113, and by extension adjust the light emission brightness of the light emission unit with high accuracy.

Specifically, in the present embodiment, the optical sensor 113 is provided between the vertices (the vertices of the n-sided polygons corresponding to the bottom surfaces) of the bottom surfaces of the two reflection units 114 adjacent to each other so as not to face the base of the reflection unit 114. With this, it is possible to suppress the detection of the reflected light from the reflection unit 114 in the optical sensor 113 and obtain the detected value having the small error caused by the warp of the optical sheet 106 as the detected value of the optical sensor 113.

In addition, in the present embodiment, the light from the light emission unit 111 is detected by the optical sensor 113 provided at the position having the distance from the light emission unit 111 corresponding to three to six times the diffusion distance 130. With this, it is possible to obtain the detected value having the small error caused by the warp of the optical sheet 106 as the detected value of the optical sensor 113.

Figure 8:
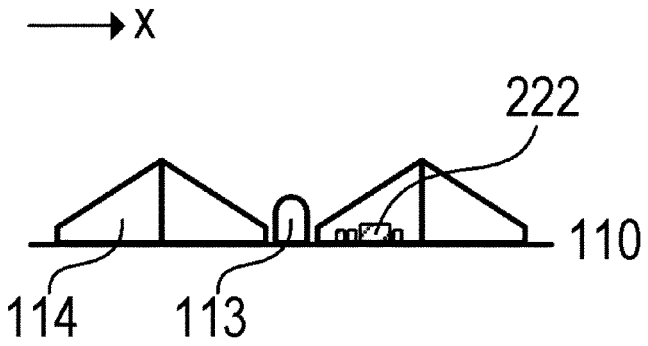
FIG. 8 shows an example of a positional relationship among the optical sensor, the reflection unit, and a peripheral circuit according to the first embodiment.

Note that, as described above, the shape of the reflection unit 114 may be the substantially polygonal pyramid shape (the shape similar to the polygonal pyramid shape), and may not be the regular polygonal pyramid shape. For example, when the light source substrate 101 is small or the member provided on the light source substrate 101 (the light emission unit 111, the reflection unit 114, or the optical sensor 113) is large, there are cases where it is not possible to secure the mounting space of the optical sensor 113. In such cases, as shown in FIG. 8, the reflection unit 114 having a shape obtained by removing the vertex portion of the polygonal pyramid on the bottom surface side may be used. FIG. 8 is a cross-sectional view showing an example of a positional relationship among the LED substrate 110, the optical sensor 113, the reflection unit 114, and a peripheral circuit 222. FIG. 8 is a cross-sectional view when the LED substrate 110 in FIG. 5 is viewed from a y direction. By using the reflection unit 114 having the shape obtained by removing the vertex portion of the polygonal pyramid on the bottom surface side, it is possible to secure the mounting space of the optical sensor 113. Specifically, it is possible to provide the optical sensor 113 at a portion from which the vertex portion is removed. Note that an influence on the brightness variation and the detection error (the error in the detected value of the optical sensor 113) caused by removing the vertex portion is extremely small.

In addition, as shown in FIG. 8, the peripheral circuit 222 of the optical sensor 113 may be provided inside the reflection unit 114. With this, it is possible to prevent the peripheral circuit 222 from obstructing other members.

Figure 9:
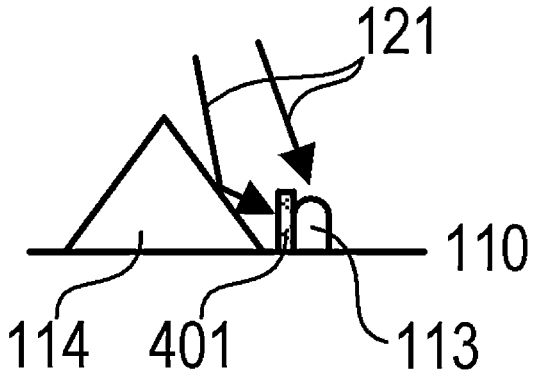
FIG. 9 shows an example of a mounting method of the optical sensor according to the present embodiment.
Figure 10:
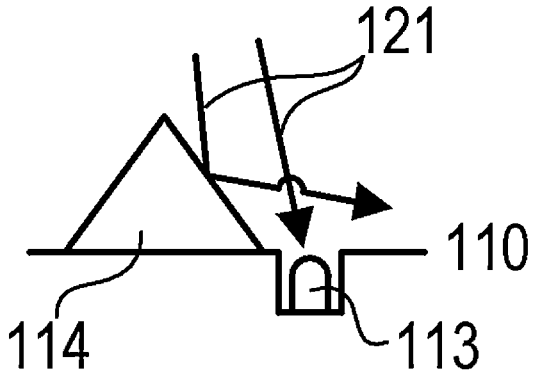
FIG. 10 shows an example of the mounting method of the optical sensor according to the present embodiment.

Note that, in the present embodiment, the description has been given of the example in which the detection of the reflected light from the reflection unit 114 is suppressed by providing the optical sensor 113 at the position that does not face the base of the reflection unit 114, but the method for suppressing the detection of the reflected light from the reflection unit 114 is not limited thereto. For example, the optical sensor 113 may also be provided as shown in FIGS. 9 and 10. Each of FIGS. 9 and 10 is a cross-sectional view showing an example of the method for suppressing the detection of the reflected light from the reflection unit 114. In an example in FIG. 9, a blocking unit 401 that blocks the reflected light from the reflection unit 114 is provided around the optical sensor 113. It is possible to suppress the detection of the reflected light from the reflection unit 114 by blocking the reflected light from the reflection unit 114 using the blocking unit 401. In an example in FIG. 10, the light source substrate 101 (the LED substrate 110) has a depressed portion, and the optical sensor 113 is provided in the depressed portion. The reflected light from the reflection unit 114 scarcely enters the depressed portion, and hence it is possible to suppress the detection of the reflected light from the reflection unit 114 by providing the optical sensor 113 in the depressed portion. In addition, according to the methods shown in FIGS. 9 and 10, the positional relationship between the optical sensor 113 and the reflection unit 114 is not limited, and hence it is possible to provide the optical sensor 113 at various positions.

Comparative Example

Figure 11:
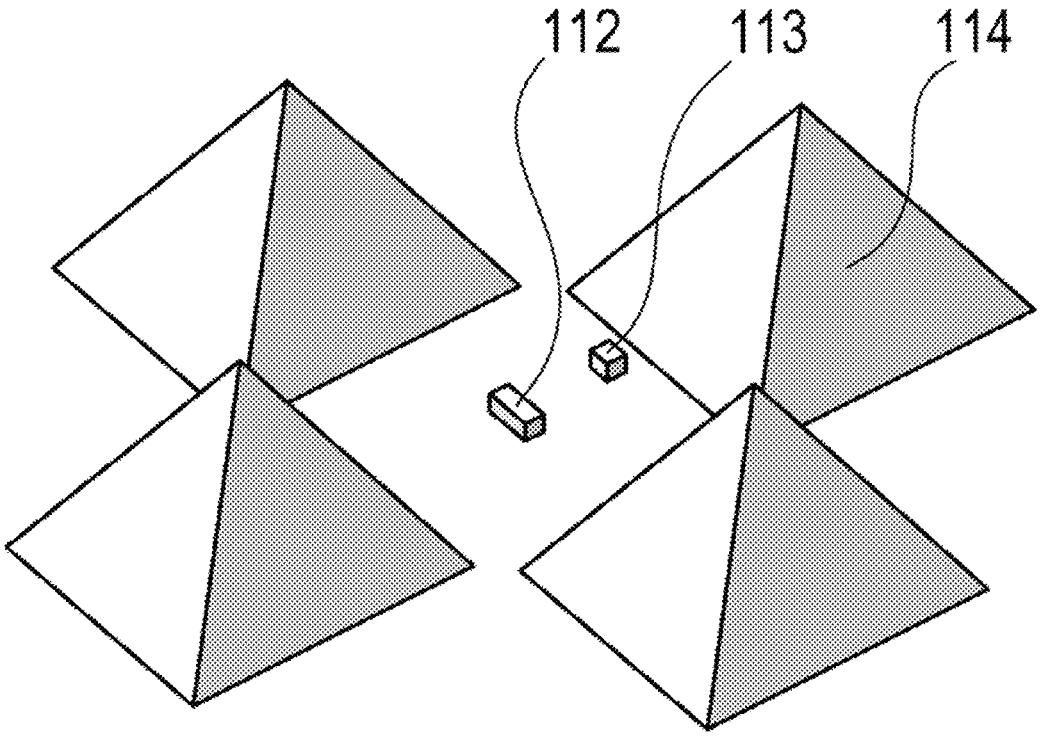
FIG. 11 shows an example of the positional relationship among the LED chip, the optical sensor, and the reflection unit according to a comparative example.

As a comparative example, a description will be given of an example in which the optical sensor 113 is provided at a position that faces the base of the reflection unit 114. FIG. 11 is a perspective view showing an example of the positional relationship among the LED chip 112, the optical sensor 113, and the reflection unit 114 in the comparative example. In FIG. 11, the LED chip 112 and the optical sensor 113 are provided at positions that face the base of the reflection unit 114.

Figure 12:
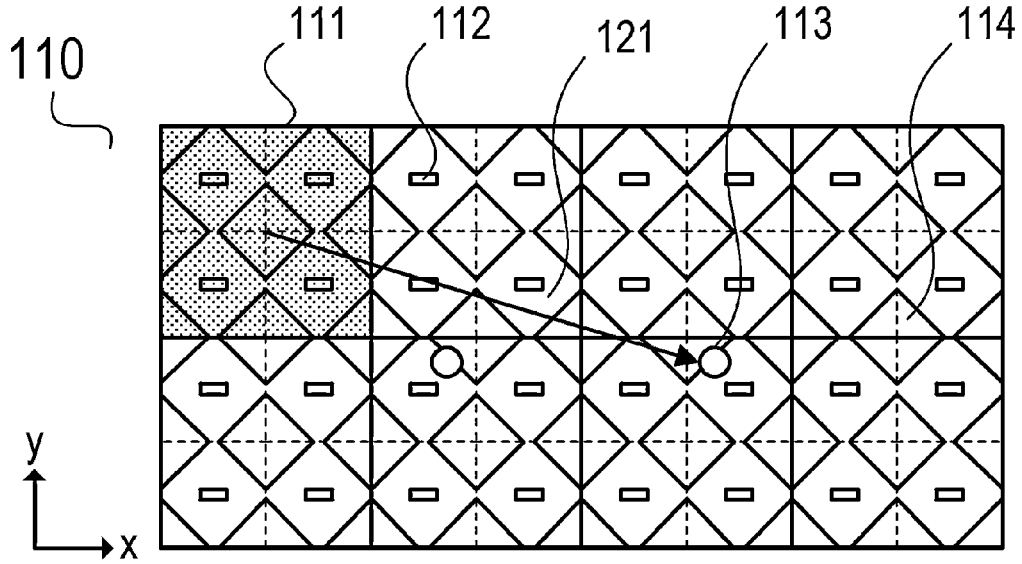
FIG. 12 shows an example of the positional relationship between the light emission unit and the adjustment optical sensor according to the comparative example.

FIG. 12 is a schematic view showing an example of the positional relationship between the light emission unit 111 and the adjustment optical sensor in the comparative example. FIG. 12 shows an example in the case where the light emission unit 111 on the upper left corner is the target light emission unit. From FIG. 12, it can be seen that two optical sensors 113 are provided on one LED substrate 110, similarly to the first embodiment (FIG. 2A). In addition, from FIG. 12, it can be seen that the optical sensor 113 is provided at the position that faces the base of the reflection unit 114. Also in the comparative example, similarly to the first embodiment, the light 121 from the target light emission unit is detected by the adjustment optical sensor pre-associated with the target light emission unit. Also in the comparative example, similarly to the first embodiment, the optical sensor 113 provided at the position having the distance from the target light emission unit corresponding to three to six times the diffusion distance is used as the adjustment optical sensor of the target light emission unit.

Figure 13:
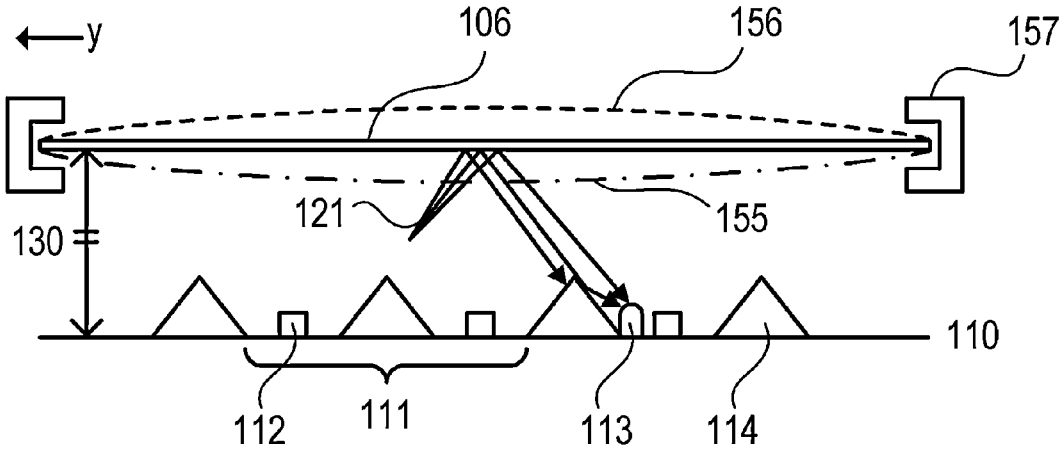
FIG. 13 shows an example of the positional relationship among the light emission unit, the optical sensor, the reflection unit, and the optical sheet according to the comparative example.

FIG. 13 is a cross-sectional view showing an example of the positional relationship among the LED substrate 110, the light emission unit 111, the optical sensor 113, the reflection unit 114, and the optical sheet 106 in the comparative example. FIG. 13 is a cross-sectional view when the LED substrate 110 in FIG. 12 is viewed from an x direction.

Similarly to the first embodiment, the light 121 from the light emission unit 111 is detected by the optical sensor 113 after being reflected by the optical sheet 106. However, in the comparative example, since the optical sensor 113 is provided at the position that faces the base of the reflection unit 114, much of the reflected light from the side surface (an inclined surface) of the reflection unit 114 enters the optical sensor 113. Depending on the positional relationship between the optical sensor 113 and the light emission unit 111, there are cases where the light from the light emission unit 111 (the reflected light from the optical sheet 106) is blocked by the reflection unit 114 and scarcely enters the optical sensor 113.

Next, a description will be given of the relationship between the change amount of the detected value caused by the warp of the optical sheet 106 and the ratio Rd in the comparative example.

Figure 14:
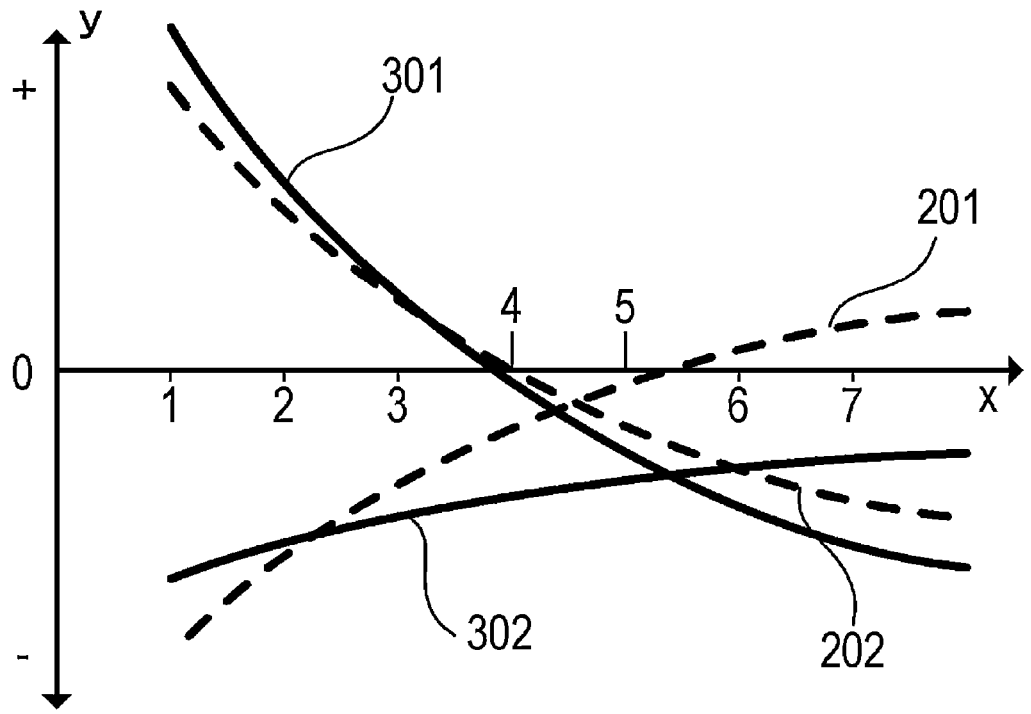
FIG. 14 shows an example of the relationship between the change amount of the detected value and the ratio Rd according to the comparative example.

FIG. 14 is a view showing in the comparative example an example of the relationship between the change amount of the detected value (the detected brightness) caused by the warp of the optical sheet 106 and the ratio Rd. In FIG. 14, the x-axis indicates the ratio Rd, and the y-axis indicates the change amount of the detected value caused by the warp of the optical sheet 106. A curve 301 indicates the change amount of the detected brightness in the case where the optical sheet 106 is warped in the minus direction by a predetermined amount. A curve 302 indicates the change amount of the detected brightness in the case where the optical sheet 106 is warped in the plus direction by a predetermined amount. FIG. 14 also shows the curves 201 and 202 in FIG. 7 for comparison.

Similarly to the first embodiment, in the comparative example, the change amount of the detected brightness caused by the warp of the optical sheet is larger with approach to the position (the position of the light emission unit 111) of the ratio Rd=0. However, the change amounts of the comparative example in a range of Rd=3 to 6 (the curves 301 and 302) are slightly smaller than the change amounts in the other ranges, but are significantly larger than the change amounts of the first embodiment (the curves 201 and 202). Similarly to the first embodiment, in a range of the ratio Rd>6, the change amount of the detected brightness caused by the warp in the minus direction is larger as the ratio Rd is larger.

Figure 15:
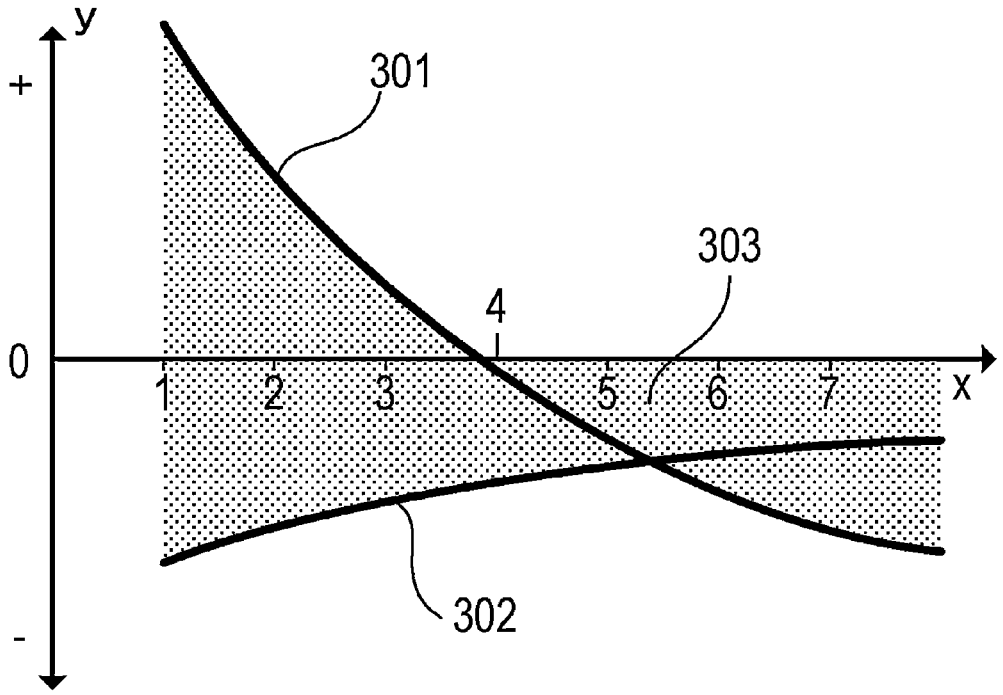
FIG. 15 shows an example of an error that can occur in the comparative example.

FIG. 15 is a view showing an example of the error that can occur in the comparative example (the error in the detected brightness that can occur due to the warp of the optical sheet 106). A filled portion 303 in FIG. 15 corresponds to the error in the detected brightness. When FIG. 15 is compared with FIG. 7, it can be seen that the detected brightness includes a large error even when the optical sensor 113 provided at the position of the ratio Rd=3 to 6 is used in the comparative example. One of the reasons why the detected brightness includes the large error is that the change amount indicated by the curve 302 in the case where the optical sheet 106 is warped in the plus direction is large irrespective of the ratio Rd. When the optical sheet 106 is warped in the plus direction, the reflected light from the reflection unit 114 to the optical sensor 113 is reduced irrespective of the ratio Rd. As a result, the change amount in the case where the optical sheet 106 is warped in the plus direction is large irrespective of the ratio Rd.

Second Embodiment

Hereinbelow, a description will be given of a display apparatus, a light source apparatus, and a control method thereof according to a second embodiment of the present invention.

In the first embodiment, the description has been given of the example in which the error in the detected value caused by the warp of the optical sheet 106 is reduced by providing the optical sensor 113 such that the optical sensor 113 does not face the base of the reflection unit 114. In the present embodiment, a description will be given of an example in which the error in the detected value is further reduced by executing a correction process that corrects the detected value.

Note that the same members as those in the first embodiment are designated by the same reference numerals, and the description thereof will be omitted.

As shown in FIG. 7, even when the optical sensor 113 is provided so as not to face the base of the reflection unit 114, it is not possible to completely block the reflected light from the reflection unit 114 to the optical sensor 113 so that a slight error occurs due to the warp of the optical sheet 106.

Figure 16:
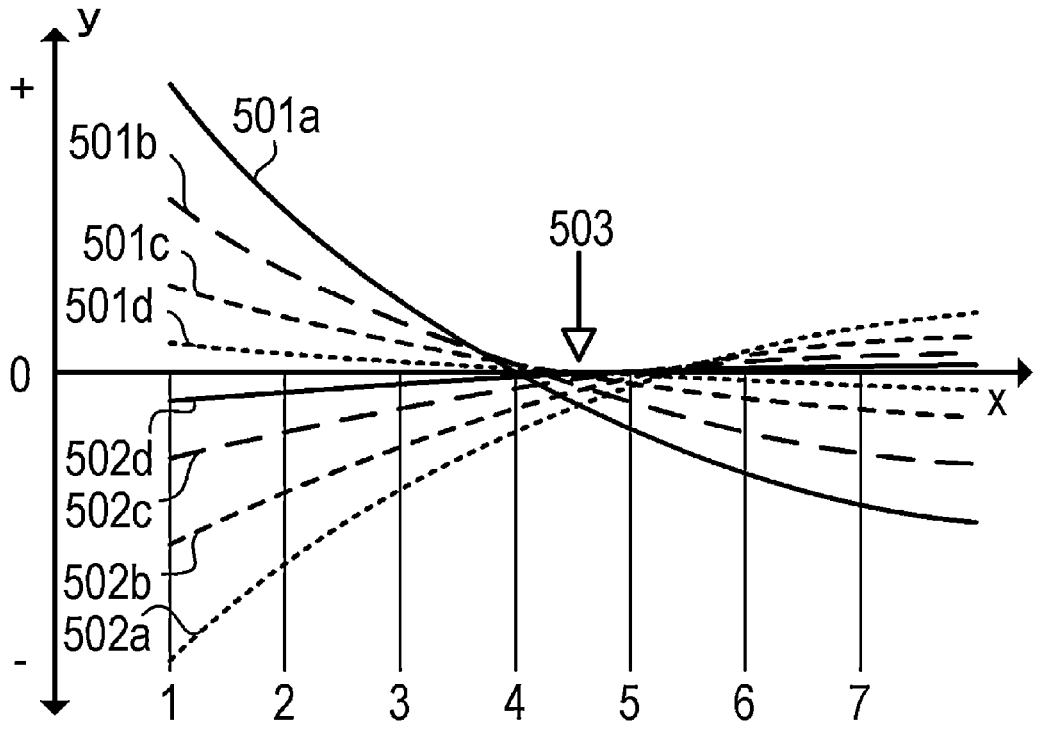
FIG. 16 shows an example of the relationship between the change amount of the detected value and the ratio Rd according to a second embodiment.

FIG. 16 is a view showing an example of the relationship between the change amount of the detected value (the detected brightness) caused by the warp of the optical sheet 106 and the ratio Rd. In FIG. 16, the x-axis indicates the ratio Rd, and the y-axis indicates the change amount of the detected brightness caused by the warp of the optical sheet 106. FIG. 16 shows eight curves having different warp amounts of the optical sheet 106. Each of four curves 501*a* to 501*d* indicates the change amount of the detected brightness in the case where the optical sheet 106 is warped in the minus direction. The curve 501*a* indicates the change amount in the case where the warp amount is larger than that of the curve 501*b*, the curve 501*b* indicates the change amount in the case where the warp amount is larger than that of the curve 501*c*, and the curve 501*c* indicates the change amount in the case where the warp amount is larger than that of the curve 501*d*. Each of four curves 502*a* to 502*d* indicates the change amount of the detected brightness in the case where the optical sheet 106 is warped in the plus direction. The curve 502*a* indicates the change amount in the case where the warp amount is larger than that of the curve 502*b*, the curve 502*b* indicates the change amount in the case where the warp amount is larger than that of the curve 502*c*, and the curve 502*c* indicates the change amount in the case where the warp amount is larger than that of the curve 502*d*. From FIG. 16, it can be seen that an error minimal point 503 at which the change mount of the detected brightness is minimized is present in a range of the ratio Rd=4 to 5. Note that the ratio Rd corresponding to the error minimal point 503 can change depending on the structure of the backlight apparatus such as the LED pitch or the directivity of the LED. In addition, it can be seen that, in the vicinity of the error minimal point 503, a minus change amount (error) occurs in the detected brightness in the case where the optical sheet 106 is warped in the minus direction or the plus direction.

Figure 17:
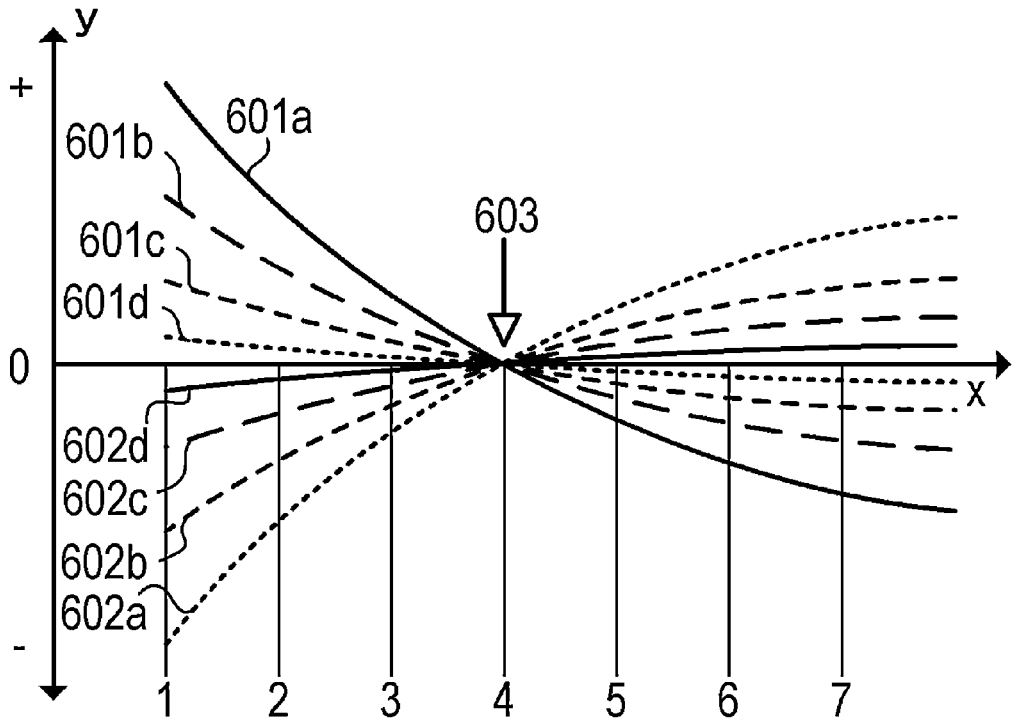
FIG. 17 shows an example of the relationship between the change amount of the detected value and the ratio Rd in the case where the reflection unit is not used.

For comparison, a description will be given of the change amount (the error) of the detected brightness in the direct backlight apparatus that does not have the reflection unit 114. FIG. 17 is a view showing an example of the relationship between the ratio Rd and the error (the change amount of the detected brightness of the optical sensor 113 caused by the warp of the optical sheet 106) in the case where the reflection unit 114 is not used. In FIG. 17, the x-axis indicates the ratio Rd, and the y-axis indicates the change amount of the detected brightness caused by the warp of the optical sheet 106. FIG. 17 shows eight curves having different warp amounts of the optical sheet 106. Each of four curves 601*a* to 601*d* indicates the change amount of the detected brightness in the case where the optical sheet 106 is warped in the minus direction. The curve 601*a* indicates the change amount in the case where the warp amount is larger than that of the curve 601*b*, the curve 601*b* indicates the change amount in the case where the warp amount is larger than that of the curve 601*c*, and the curve 601*c* indicates the change amount in the case where the warp amount is larger than that of the curve 601*d*. Each of four curves 602*a* to 602*d* indicates the change amount of the detected brightness in the case where the optical sheet 106 is warped in the plus direction. The curve 602*a* indicates the change amount in the case where the warp amount is larger than that of the curve 602*b*, the curve 602*b* indicates the change amount in the case where the warp amount is larger than that of the curve 602*c*, and the curve 602*c* indicates the change amount in the case where the warp amount is larger than that of the curve 602*d*. As can be seen from FIG. 17, in the vicinity of the ratio Rd=4, an error zero-crossing point 603 at which the change amount of the detected brightness becomes zero is present. Note that the ratio Rd corresponding to the error zero-crossing point 603 can change depending on the structure of the backlight apparatus such as the LED pitch or the directivity of the LED. In addition, it can be seen that, at the error zero-crossing point 603, the change amount (the error) of the detected brightness becomes substantially zero in the case where the optical sheet 106 is warped in the minus direction or the plus direction.

Thus, in the configuration in which the reflection unit 114 is used, even when the optical sensor 113 is disposed in the vicinity of the error minimal point 503, the slight error occurs in the detected value. To cope with this, in the present embodiment, the error in the detected value is reduced by correcting the detected value.

Figure 18:
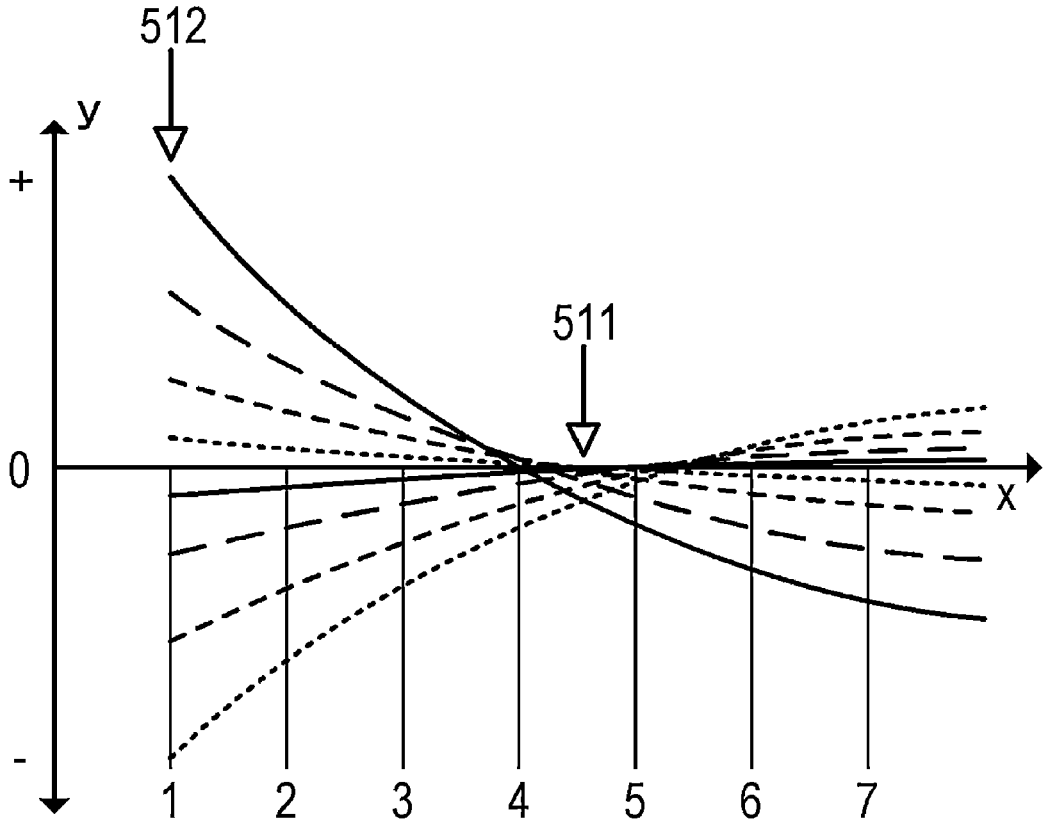
FIG. 18 shows an example of the position of each of an adjustment optical sensor and an error correction optical sensor according to the second embodiment.

In the present embodiment, when the light emission brightness of the light emission unit 111 is adjusted, not only the adjustment optical sensor but also an error correction optical sensor is used. FIG. 18 is a view showing an example of the relationship between the change amount of the detected value (the detected brightness) caused by the warp of the optical sensor 106 and the ratio Rd, and is also a view showing an example of the position of each of the adjustment optical sensor and the error correction optical sensor. The reference numeral 511 denotes the value of Rd corresponding to the position of the adjustment optical sensor, and the reference numeral 512 denotes the value of Rd corresponding to the position of the error correction optical sensor. The adjustment optical sensor is the optical sensor 113 (the first detection unit) used to detect and adjust the light from the light emission unit 111 (the target light emission unit) as the adjustment target of the light emission brightness. The error correction optical sensor is the optical sensor 113 (a second detection unit) used to correct the change (the error) of the detected value of the adjustment optical sensor caused by the warp of the optical sensor 106. In the present embodiment, the optical sensor 113 having the distance from the target light emission unit shorter than that of the adjustment optical sensor is used as the error correction optical sensor. The reason for this will be described later. In the example in FIG. 18, the optical sensor 113 provided in the vicinity of the error minimal point at which the change amount of the detected value is minimized is used as the adjustment optical sensor. The optical sensor 113 provided at the position at which the change amount of the detected value is large is used as the error correction optical sensor. Specifically, the optical sensor 113 provided in the vicinity of the position of the ratio Rd=1 is used as the error correction optical sensor. That is, the optical sensor 113 provided near the target light emission unit 111 is used as the error correction optical sensor.

Figure 19:
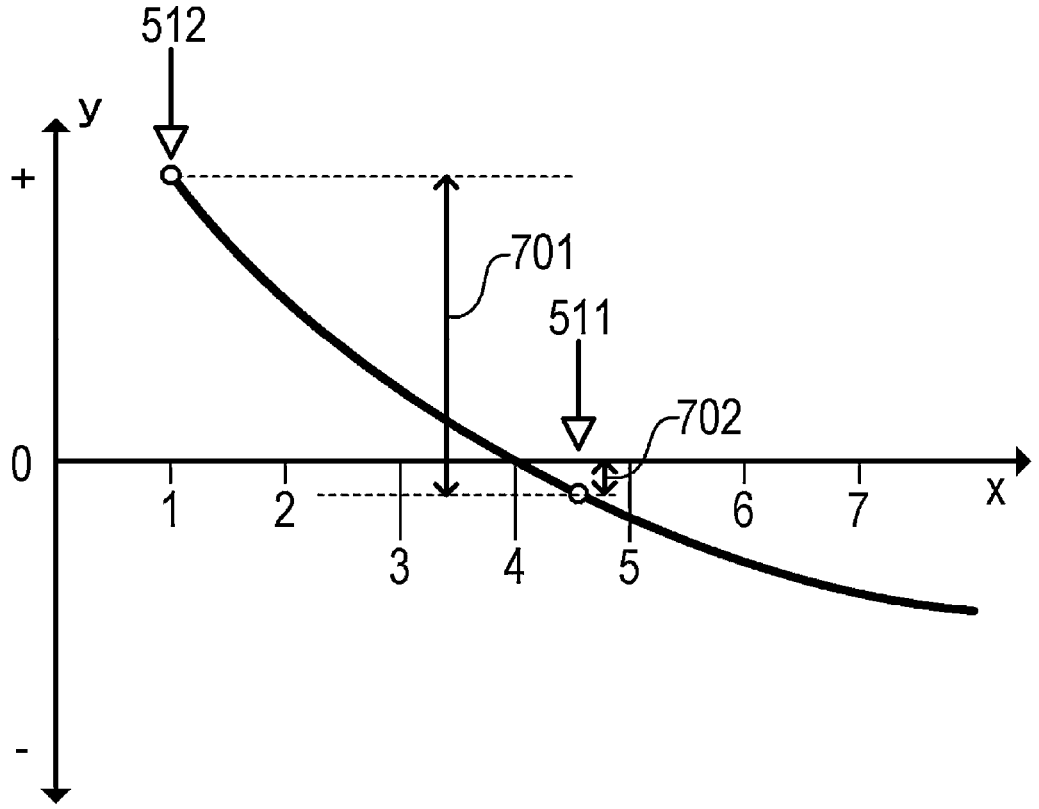
FIG. 19 shows an example of a method of a correction process according to the second embodiment.

FIG. 19 is a view for explaining a method for correcting the detected value of the adjustment optical sensor based on the detected value of the adjustment optical sensor and the detected value of the error correction optical sensor. In FIG. 19, the x-axis indicates the ratio Rd, and the y-axis indicates the change amount of the detected brightness caused by the warp of the optical sheet 106.

In the present embodiment, the detected value of the adjustment optical sensor is corrected based on a difference between the detected value of the adjustment optical sensor and the detected value of the error correction optical sensor. The reference numeral 701 denotes the difference (a deviation amount) between the detected value of the adjustment optical sensor and the detected amount of the error correction optical sensor. The reference numeral 702 denotes the error included in the detected value of the adjustment optical sensor. From FIG. 19, it can be seen that the deviation amount 701 changes with the change of the warp amount. In addition, it can be seen that the error 702 is larger as the deviation amount 701 is larger. Accordingly, in the correction process, the deviation amount 701 is calculated, and the detected value of the adjustment optical sensor is corrected such that a difference between the detected value before the correction and the detected value after the correction is larger as the deviation amount 701 is larger.

The correction process is performed by, e.g., the microcomputer 125.

In addition, from FIG. 18, it can be seen that the change amount of the detected value is large in the optical sensor 113 having the short distance from the target light emission unit. Accordingly, by using such an optical sensor 113, it is possible to detect the change of the deviation amount caused by the change of the warp amount with higher accuracy and correct the detected value of the adjustment optical sensor with higher accuracy. Further, from FIG. 18, it can be seen that the change of the deviation amount caused by the change of the warp amount is larger in the case where the optical sensor 113 having the small change amount of the detected value and the optical sensor 113 having the large change amount of the detected value are used than in the case where the two optical sensors 113 having similar change amounts of the detected value are used. Consequently, by using the optical sensor 113 having the small change amount of the detected value and the optical sensor 113 having the large change amount of the detected value, it is possible to detect the change of the deviation amount caused by the change of the warp amount with higher accuracy and correct the detected value of the adjustment optical sensor with higher accuracy. From these reasons, in the present embodiment, the optical sensor 113 having the small change amount of the detected value is used as the adjustment optical sensor, and the optical sensor 113 having the large change amount of the detected value is used as the error correction optical sensor.

Figures 20, 21:
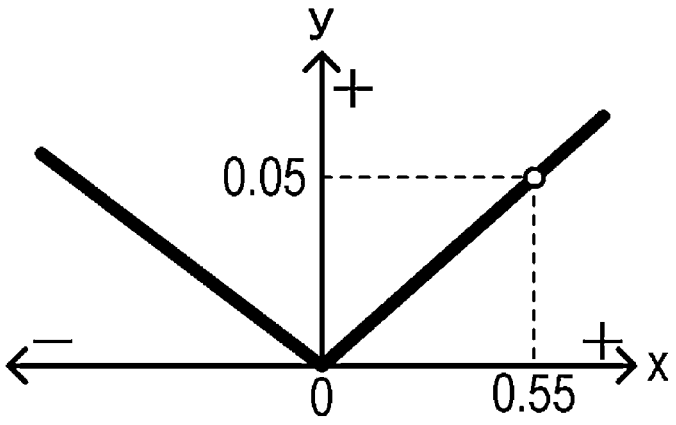
FIG. 20 shows an example of the detected value of each of the adjustment optical sensor and the error correction optical sensor according to the second embodiment.
FIG. 21 shows an example of correspondence information according to the second embodiment.

FIG. 20 is a view showing an example of the detected value of each of the adjustment optical sensor and the error correction optical sensor. In the present embodiment, the detected values of the adjustment optical sensor and the error correction optical sensor are recorded in the non-volatile memory 126 as reference detected values at the time of the manufacturing test of the color image display apparatus. The reference detected value of the adjustment optical sensor is used as the brightness target value. The adjustment optical sensor is provided at the position far from the target light emission unit 111, and hence the absolute value of the reference detected value of the adjustment optical sensor is small. On the other hand, the error correction optical sensor is provided at the position close to the light emission unit 111, and hence the absolute value of the reference detected value of the error correction optical sensor is large. In FIG. 20, the reference detected value is normalized to 1. As shown in FIG. 20, each of the reference detected value of the adjustment optical sensor and the reference detected value of the error correction optical sensor is 1.00. When the backlight apparatus is used, the light emission brightness of the light emission unit 111 changes due to the temperature and the aged degradation.

"POST-CHANGE DETECTED VALUE" in FIG. 20 denotes the detected value in the case where the light emission brightness of the target light emission unit 111 is reduced by 10% due to a temperature rise. From FIG. 20, it can be seen that each of the post-change detected value of the adjustment optical sensor and the post-change detected value of the error correction optical sensor is 0.90, and both of the detected value of the adjustment optical sensor and the detected value of the error correction optical sensor are reduced by 10%.

However, when the error caused by the warp of the optical sheet 106 occurs, the difference (the deviation) between the detected value of the adjustment optical sensor and the detected value of the error correction optical sensor occurs. "POST-WARP DETECTED VALUE" in FIG. 20 denotes the detected value when the warp of the optical sheet is present. Herein, as shown in FIG. 19, it is assumed that the deviation that increases the detected value of the error correction optical sensor and reduces the detected value of the adjustment optical sensor occurs. From FIG. 20, it can be seen that the post-warp detected value of the adjustment optical sensor is 0.85, the post-warp detected value of the error correction optical sensor is 1.40, and the deviation amount 701 is 1.40−0.85=+0.55. In the present embodiment, the correction value (or the error 702) of the correction process is determined from the deviation amount 701.

Note that, in the present embodiment, a value obtained by subtracting the detected value of the error correction optical sensor from the detected value of the adjustment optical sensor is used as the deviation amount 701, but a value obtained by subtracting the detected value of the adjustment optical sensor from the detected value of the error correction optical sensor may also be used as the deviation amount 701.

In the present embodiment, correspondence information indicative of a correspondence between the deviation amount and the correction value is prepared in advance. In the correction process, the correction value corresponding to the deviation amount 701 is determined based on the correspondence information (a table or a function), and the detected value of the adjustment optical sensor is corrected using the determined correction value.

FIG. 21 is a view showing an example of the correspondence information. In FIG. 21, the x-axis indicates the deviation amount, and the y-axis indicates the correction value. In the case where the correspondence information shown in FIG. 21 is used, when the deviation amount 701=+0.55 is satisfied (when the post-warp detected value of the adjustment optical sensor is 0.85 and the post-warp detected value of the error correction optical sensor is 1.40), the correction value=+0.05 is obtained. In the correction process, the correction value is added to the detected value (the post-warp detected value) of the adjustment optical sensor. Consequently, as the detected value of the adjustment optical sensor after the correction, 0.85+0.05=0.90 is obtained. The value (0.9) is equal to the post-change detected value (the post-change detected value of the adjustment optical sensor) that does not include the error caused by the warp of the optical sheet. From this, it can be seen that the error caused by the warp of the optical sheet 106 is reduced (eliminated) by the addition of the correction value.

The correspondence information can be generated based on the result of measurement of the error caused by the warp of the optical sheet 106. Specifically, the color image display apparatus is activated and aging is performed for several hours such that the temperature of the backlight apparatus is sufficiently stabilized. Next, the detected value (a pre-warp detected value) of the adjustment optical sensor is acquired before the optical sheet 106 is intentionally warped. Thereafter, the optical sheet 106 is intentionally warped by applying an external force to the optical sheet 106 or tilting the optical sheet 106. Subsequently, the detected value (the post-warp detected value) of the adjustment optical sensor and the detected value (the post-warp detected value) of the error correction optical sensor are acquired in a state in which the optical sheet 106 is intentionally warped. At this point, the change of the light emission brightness of the target light emission unit 111 caused by the temperature change or the like is not present, and hence the difference between the pre-warp detected value of the adjustment optical sensor and the post-warp detected value thereof corresponds to the error 702. The difference between the post-warp detected value of the adjustment optical sensor and the post-warp detected value of the error correction optical sensor corresponds to the deviation amount 701 (the deviation amount of the post-warp detected value). Consequently, it is possible to determine the correction value corresponding to the deviation amount of the post-warp detected value in accordance with the difference between the pre-warp detected value of the adjustment optical sensor and the post-warp detected value thereof. Herein, the correction value corresponding to the deviation amount of the post-warp detected value is calculated by multiplying the difference between the pre-warp detected value of the adjustment optical sensor and the post-warp detected value thereof by −1. By determining the deviation amounts and the correction values for a plurality of the warp amounts, the correspondence information indicative of the correspondence between the deviation amount and the correction value is generated. As the number of the warp amounts for acquiring the post-warp detected values is larger, it is possible to generate the correspondence information with higher accuracy. The generated correspondence information is recorded in the non-volatile memory 126 so as to be used in the microcomputer 125 at any time.

Note that it is not easy to generate the correspondence information for each color image display apparatus. Consequently, the respective detected values of a plurality of the color image display apparatuses (samples) may be acquired and a representative value representing a plurality of the detected values obtained from the plurality of the color image display apparatuses may be calculated. Subsequently, the correspondence information common to the plurality of the color image display apparatuses may be generated using the representative value. Alternatively, the measurement of the error and the deviation amount may be performed on each of the plurality of the color image display apparatuses, and a representative value representing a plurality of the errors obtained from the plurality of the color image display apparatuses and a representative value representing a plurality of the deviation amounts obtained from the plurality of the color image display apparatuses may be calculated. Subsequently, the correspondence information common to the plurality of the color image display apparatuses may be generated using the representative value of the error and the representative value of the deviation amount. With this, it is possible to reduce a processing load and a processing time required to generate the correspondence information.

Note that information indicative of the correspondence between the deviation amount and the error (the error caused by the warp of the optical sheet 106) may be prepared as the correspondence information.

As described thus far, according to the present embodiment, the detected value of the adjustment optical sensor is corrected based on the difference between the detected value of the adjustment optical sensor and the detected value of the error correction optical sensor. With this, it is possible to obtain the detected value having the small error caused by the warp of the optical sheet as the detected value of the optical sensor, and by extension adjust the light emission brightness of the light emission unit with high accuracy. Specifically, it becomes possible to obtain the detected value having the error smaller than that in the first embodiment.

Note that, in the present embodiment, the description has been given of the example in which the optical sensor 113 provided in the vicinity of the error minimal point is used as the adjustment optical sensor, but the position of the adjustment optical sensor is not limited thereto.

Figure 22:
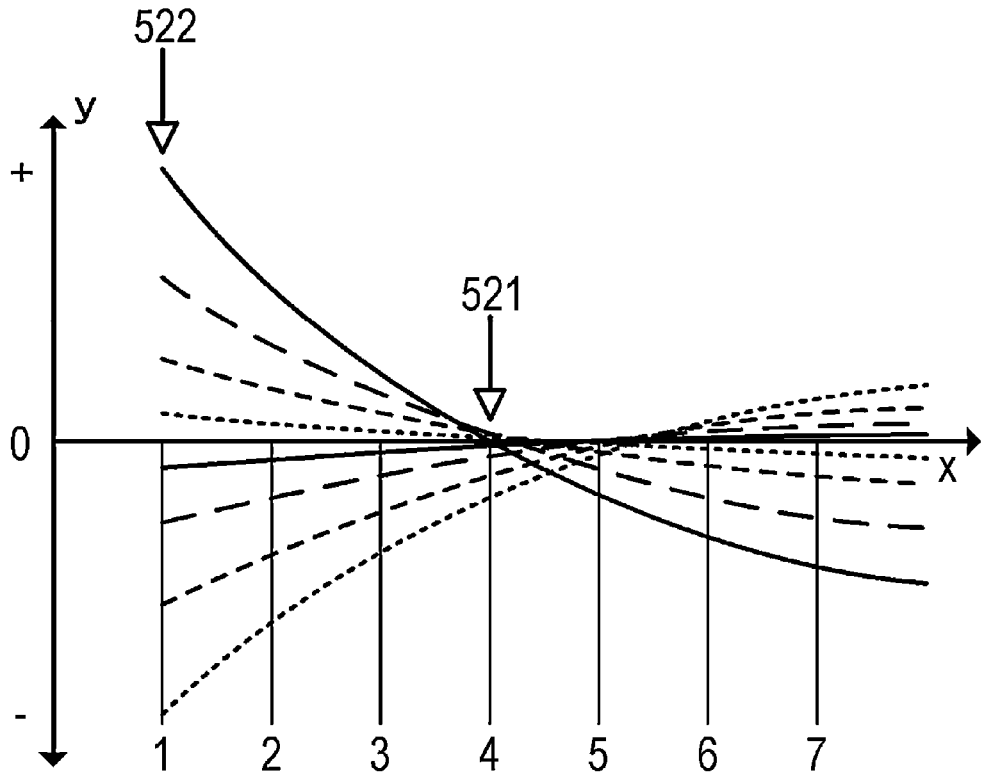
FIG. 22 shows an example of the position of each of the adjustment optical sensor and the error correction optical sensor according to the second embodiment.

FIG. 22 shows an example in which the optical sensor 113 provided at a position apart from the error minimal point is used as the adjustment optical sensor. FIG. 22 is a view showing an example of the relationship between the change amount of the detected value (the detected brightness) caused by the warp of the optical sheet 106 and the ratio Rd, and is also a view showing an example of the position of each of the adjustment optical sensor and the error correction optical sensor. The reference numeral 521 denotes the value of Rd corresponding to the position of the adjustment optical sensor, and the reference numeral 522 denotes the value of Rd corresponding to the position of the error correction optical sensor. From FIG. 22, it can be seen that the position of the adjustment optical sensor is apart from the error minimal point. The position of the error correction optical sensor is the same as that in FIG. 19. Even when the position of the adjustment optical sensor is apart from the error minimal point, it is possible to generate the correspondence information by using the above-described method, and reduce the error.

Figure 23:
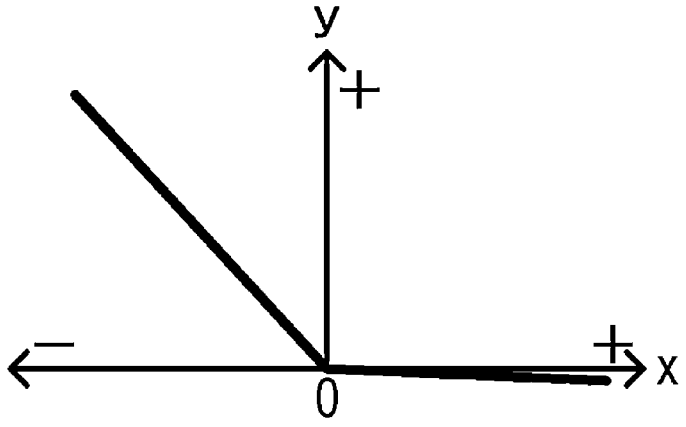
FIG. 23 shows an example of the correspondence information according to the second embodiment.

It can be seen that, in the case where the adjustment optical sensor and the error correction optical sensor shown in FIG. 22 are used, the increase of the deviation amount relative to the increase of the warp amount of the optical sheet 106 in the plus direction is small, and the increase of the deviation amount relative to the increase of the warp amount of the optical sheet 106 in the minus direction is large. Accordingly, in the case where the adjustment optical sensor and the error correction optical sensor shown in FIG. 22 are used, correspondence information shown in FIG. 23 is generated in advance and used. In FIG. 23, the x-axis indicates the deviation amount, and the y-axis indicates the correction value.

Thus, even when the optical sensor 113 provided at the position apart from the error minimal point is used as the adjustment optical sensor, it is possible to reduce the error by the correction process.

In order to provide the optical sensor 113 in the vicinity of the error minimal point for each of a large number of the light emission units 111, it is necessary to provide a large number of the optical sensors 113. When the optical sensor 113 provided at the position apart from the error minimal point is used as the adjustment optical sensor, it becomes possible to use one optical sensor 113 common to a plurality of the light emission units 111 instead of a plurality of the adjustment optical sensors of a plurality of the light emission units 111. As a result, it is possible to reduce the total number of the optical sensors 113.

Similarly, the position of the error correction optical sensor is not particularly limited. In the present embodiment, the optical sensor having the distance from the target light emission unit shorter than that of the adjustment optical sensor has been used as the error correction optical sensor, but the optical sensor having the distance from the target light emission unit longer than that of the adjustment optical sensor may be used as the error correction optical sensor. In addition, each of the adjustment optical sensor and the error correction optical sensor may be provided at a position at which a large amount of the reflected light from the reflection unit is detected. By not limiting the position of the error correction optical sensor, it is possible to reduce the total number of the optical sensors 113. When the positions of both of the adjustment optical sensor and the error correction optical sensor are not limited, it is possible to further reduce the total number of the optical sensors 113. However, from the viewpoint of the accuracy of the correction process, it is preferable to use the optical sensor having the distance from the target light emission unit shorter than that of the adjustment optical sensor as the error correction optical sensor. In addition, the error is not necessarily eliminated completely by the correction process, and hence the adjustment optical sensor is preferably provided such that the reflected light from the reflection unit is not detected.

Note that the error correction optical sensor may be the optical sensor used only for correcting the error or the optical sensor used as the adjustment optical sensor when the light emission brightness of the other light emission unit 111 is adjusted. However, from the viewpoint of the accuracy of the correction process, the error correction optical sensor is preferably provided such that a large amount of the reflected light from the reflection unit is detected. As described above, the adjustment optical sensor is preferably provided such that the reflected light from the reflection unit is not detected. Accordingly, the error correction optical sensor is preferably the optical sensor used only for correcting the error.

Figure 24:
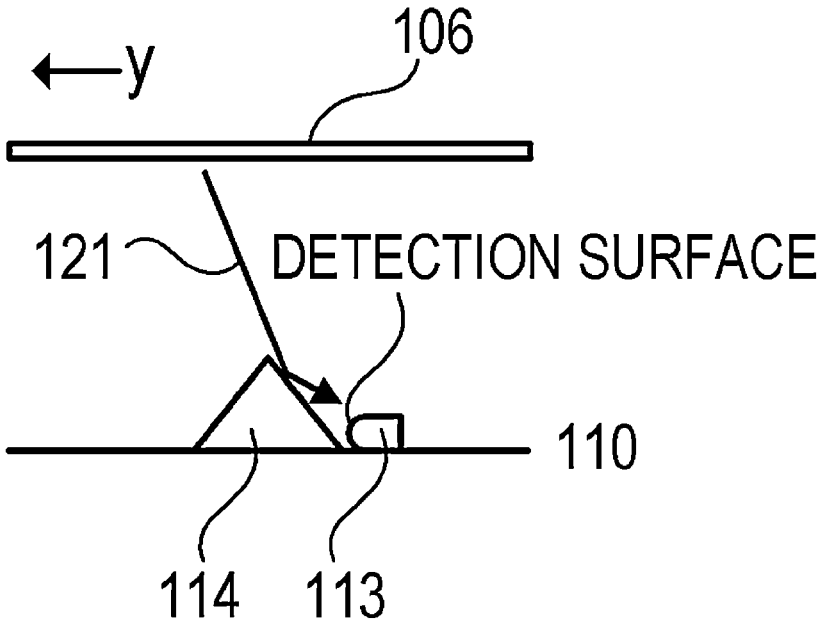
FIG. 24 shows an example of the optical sensor suitable as the error correction optical sensor according to the second embodiment.
Figure 25:
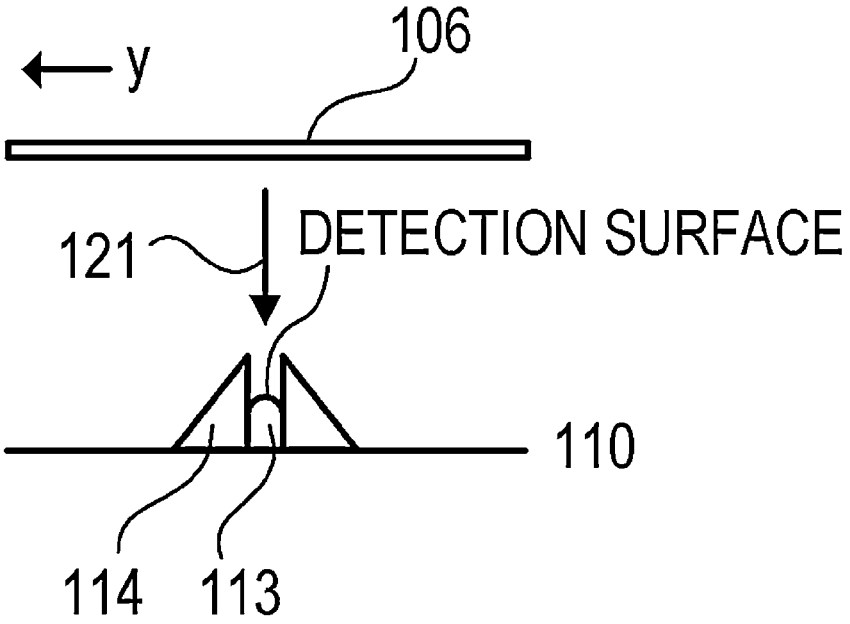
FIG. 25 shows an example of the optical sensor suitable as the error correction optical sensor according to the second embodiment.

Each of FIGS. 24 and 25 is a view showing an example of the optical sensor (the optical sensor suitably used as the error correction optical sensor) provided such that a large amount of the reflected light from the reflection unit is detected. In FIG. 24, the optical sensor is provided such that a detection surface is directed toward the reflection unit 114. In FIG. 25, the optical sensor is provided such that the detection surface is directed toward a position facing the reflection unit 114 among positions on the optical sheet. In FIG. 25, the optical sensor is provided in a hole provided in the reflection unit 114.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-036394, filed on Feb. 27, 2014, which is hereby incorporated by reference herein in its entirety.

What is claimed is:

1. A light source apparatus comprising:

a substrate;

a light emission unit that is provided on the substrate;

a plurality of reflection units configured to reflect light from the light emission unit; and a first detection unit that is provided on the substrate and detects the light from the light emission unit, wherein each of the reflection units has a substantially n-sided pyramid shape (n is an integer not less than 3) and is provided such that a bottom surface thereof is in parallel with the substrate, and the first detection unit is provided between a vertex of an n-sided polygon corresponding to the bottom surface of one of two of the reflection units adjacent to each other and a vertex of an n-sided polygon corresponding to the bottom surface of the other of two of the reflection units adjacent to each other.

2. The light source apparatus according to claim 1, wherein the first detection unit is provided at a position that does not face a side of the n-sided polygon corresponding to the bottom surface of the reflection unit.

3. The light source apparatus according to claim 1, further comprising:

an optical sheet that is provided at a position that faces the light emission unit, wherein the first detection unit is provided at a position spaced apart from the light emission unit by a distance corresponding to three to six times a distance between the light emission unit and the optical sheet.

4. The light source apparatus according to claim 1, wherein the reflection unit has a shape obtained by removing a vertex portion of a polygonal pyramid on a bottom surface side thereof, and the first detection unit is provided at a portion of the removed vertex portion.

5. The light source apparatus according to claim 1, further comprising:

a blocking unit that is provided around the first detection unit and blocks reflected light from the reflection unit.

6. The light source apparatus according to claim 1, wherein the substrate has a depressed portion, and the first detection unit is provided in the depressed portion.

7. The light source apparatus according to claim 1, wherein a peripheral circuit of the first detection unit is provided inside the reflection unit.

8. The light source apparatus according to claim 1, wherein the plurality of the reflection units are provided so as to surround the light emission unit.

9. The light source apparatus according to claim 1, further comprising:

a plurality of the light emission units, wherein the plurality of the reflection units are provided such that each of the light emission units is surrounded by two or more of the reflection units.

10. The light source apparatus according to claim 1, wherein the light emission unit has a plurality of light sources, and the plurality of the reflection units are provided such that each of the light sources is surrounded by two or more of the reflection units.

11. The light source apparatus according to claim 10, wherein the light source is provided at a position that faces a side of the n-sided polygon corresponding to the bottom surface of the reflection unit.

12. The light source apparatus according to claim 1, further comprising:

a second detection unit that is provided on the substrate and detects the light from the light emission unit; and correction means for correcting a detected value of the first detection unit, based on a difference between the detected value of the first detection unit and a detected value of the second detection unit.

13. The light source apparatus according to claim 12, wherein a distance between the light emission unit and the second detection unit is shorter than a distance between the light emission unit and the first detection unit.

14. The light source apparatus according to claim 12, wherein the correction means corrects the detected value of the first detection unit such that a difference between the detected value of the first detection unit before the correction and the detected value of the first detection unit after the correction becomes larger as the difference between the detected value of the first detection unit and the detected value of the second detection unit is larger.

15. The light source apparatus according to claim 12, wherein correspondence information indicative of a correspondence between the difference of the detected value and a correction value is prepared in advance, and the correction means determines the correction value corresponding to the difference between the detected value of the first detection unit and the detected value of the second detection unit, based on the correspondence information and corrects the detected value of the first detection unit, using the determined correction value.

16. The light source apparatus according to claim 12, wherein the second detection unit is provided such that a detection surface is directed toward the reflection unit.

17. The light source apparatus according to claim 12, wherein a detection surface of the second detection unit is directed toward a position that faces the reflection unit on an optical sheet provided at a position that faces the light emission unit.

18. A display apparatus comprising:

the light source apparatus according to claim 1; and a display unit that displays an image on a screen by modulating light from the light source apparatus.

* * * * *